US011217871B2

(12) United States Patent
Kawamura et al.

(10) Patent No.: US 11,217,871 B2
(45) Date of Patent: Jan. 4, 2022

(54) DISTRIBUTOR AND SYNTHESIZER

(71) Applicant: Sony Semiconductor Solutions Corporation, Kanagawa (JP)

(72) Inventors: Takashi Kawamura, Kanagawa (JP); Masahiro Sato, Tokyo (JP); Takanori Okamura, Kanagawa (JP); Taichi Yamada, Tokyo (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 16/626,301

(22) PCT Filed: Jun. 15, 2018

(86) PCT No.: PCT/JP2018/022857
§ 371 (c)(1),
(2) Date: Dec. 23, 2019

(87) PCT Pub. No.: WO2019/003952
PCT Pub. Date: Jan. 3, 2019

(65) Prior Publication Data

US 2020/0161737 A1 May 21, 2020

(30) Foreign Application Priority Data

Jun. 29, 2017 (JP) ..... JP2017-127020

(51) Int. Cl.
*H01P 5/19* (2006.01)
*H01P 1/18* (2006.01)
*H01P 3/08* (2006.01)

(52) U.S. Cl.
CPC ..... *H01P 5/19* (2013.01); *H01P 1/18* (2013.01); *H01P 3/08* (2013.01)

(58) Field of Classification Search
CPC ..... H01P 5/19; H01P 5/18; H01P 3/08
See application file for complete search history.

(56) References Cited

U.S. PATENT DOCUMENTS 5,021,755 A * 6/1991 Gustafson ..... H01P 5/16 333/128
7,164,903 B1 * 1/2007 Cliff ..... H01P 5/185 333/116

(Continued)

FOREIGN PATENT DOCUMENTS

CN 1179030 A 4/1998
CN 1938898 A 3/2007

(Continued)

OTHER PUBLICATIONS

U. H. Gysel, "A New N-Way Power Divider/Combiner Suitable for High-Power Applications," Standford Research Institute, Menio Park, CA 94025, Sep. 11, 2018.

(Continued)

*Primary Examiner* — Stephen E. Jones
*Assistant Examiner* — Kimberly E Glenn
(74) *Attorney, Agent, or Firm* — Michael Best & Friedrich LLP

(57) ABSTRACT

A distributor and a synthesizer with low loss are disclosed. In one example, a distributor/synthesizer has a distribution line that distributes a path from an input branch unit connected to an external transmission line on an input side into n-distributed paths. An output branch unit divides the n-distributed paths into an internal side and an external transmission line on an output side. On the internal side, a phase adjustment unit is arranged between the output branch unit and a coupling terminal, and adjusts the phase. A phase rotation amount from the input branch unit to the output branch unit of each of the n-distributed paths is π/2 [rad], and a phase rotation amount from the output branch unit to the coupling terminal is π [rad] or a real number multiple of π [rad]. The present disclosure can, for example, be applied to an FEM of a signal processing device.

16 Claims, 13 Drawing Sheets

(56) References Cited

U.S. PATENT DOCUMENTS

| | | | | |
|---|---|---|---|---|
| 8,698,577 | B2 * | 4/2014 | Sherrer | H01P 5/12 333/127 |
| 2007/0200204 | A1 | 8/2007 | Suzuki et al. | |
| 2013/0093533 | A1 | 4/2013 | Yu et al. | |

FOREIGN PATENT DOCUMENTS

| | | | |
|---|---|---|---|
| CN | 101465457 | A | 6/2009 |
| CN | 103943930 | A | 7/2014 |
| CN | 104051822 | A | 9/2014 |
| EP | 2471141 | B1 | 9/2013 |
| JP | 49-128142 | U | 11/1974 |
| JP | 55-073119 | | 6/1980 |
| JP | 02-203604 | | 8/1990 |
| JP | 09-321509 | | 12/1997 |
| JP | 11-097952 | | 8/1999 |
| JP | 11-340712 | | 12/1999 |
| JP | 2013-502874 | A | 1/2013 |

OTHER PUBLICATIONS

Chinese Office Action dated Mar. 15, 2021 for corresponding Chinese Application No. 2018800417410.

"Microwave Integrated Circuit Design" May 31, 1978 GU, Qizheng et al., Posts & Telecom Press Co., Ltd 310-311.

Chinese Notification to Grant Patent Right For Invention dated Aug. 17, 2021 for corresponding Chinese Application No. 201880041741.0.

Xu Hongjie, ,"Research on the key technology of the front end of active phase array antenna", Full Text «China's outstanding master's degree thesis full-text database information section5» Apr. 18, 2007.

* cited by examiner

DISTRIBUTOR AND SYNTHESIZER

TECHNICAL FIELD

The present technology relates to a distributor and a synthesizer, and particularly, to a distributor and a synthesizer that can achieve downsizing and low loss.

BACKGROUND ART

In order to configure a multi-distribution Wilkinson distributor on a substrate, a method of connecting two-distributor in a tournament form has been conventionally used. However, if the distribution number is large, the total transmission line length becomes long, leading to an increase in size and an increase in loss.

Therefore, Patent Document 1 has proposed that a basic Wilkinson multi-distributor is configured by wiring using a VIA on a multilayer substrate. With this proposal, four divisions can be achieved in three layers and six divisions in five layers, so that the wiring length can be made shorter than a distributor achieved by connecting a two-distribution circuit on a substrate in a tournament system.

CITATION LIST

Patent Document

Patent Document 1: Japanese Patent Application Laid-Open No. H11-97952

SUMMARY OF THE INVENTION

Problems to be Solved by the Invention

By the way, in the fifth generation mobile communication (5G), a high frequency band of 20 GHz or more is assumed. In the case of such a high frequency band, according to the technology disclosed in Patent Document 1, the number of stacked layers increases as the distribution number increases, and the length of the VIA serving as a wiring connecting isolation resistors becomes longer. As a result, the wavelength cannot be ignored at the high frequency assumed in 5G, and the necessary isolation characteristics may not be satisfied.

The present technology has been made in view of such circumstances, and can achieve downsizing and low loss.

Solutions to Problems

A distributor of an aspect of the present technology is formed on a substrate and includes: an input branch unit connected to an external transmission line on an input side; a distribution line that distributes a path from the input branch unit into n; an output branch unit that is connected to an output side of the distribution line and divides n-distributed paths into an internal side and the external transmission line on the output side; a coupling terminal that couples the n-distributed paths on the internal side; and a phase adjustment unit that is arranged between the output branch unit and the coupling terminal so as to be connected in series with a resistor, and adjusts a phase, in which a phase rotation amount from the input branch unit to the output branch unit of each of the re-distributed paths is $\pi/2$ [rad], and a phase rotation amount from the output branch unit to the coupling terminal is $\pi$[rad] or a real number multiple of $\pi$[rad].

The phase adjustment unit is arranged between the output branch unit and the resistor.

The phase adjustment unit is arranged between the resistor and the coupling terminal.

The phase adjustment unit includes a first phase adjustment unit connected to the output branch unit, and a second phase adjustment unit connected to the coupling terminal, and the resistor is arranged between the first phase adjustment unit and the second phase adjustment unit.

When input impedance is $Z_{in}$, output impedance is $Z_{out}$, and distribution number is n, characteristic impedance $Z_1$ of the distribution line is designed as $\sqrt{(n\ Z_{in}\ Z_{out})}$ and a resistance value R of the resistor is designed as $Z_{out}$.

Characteristic impedance $Z_2$ of the phase adjustment unit is designed to be in a range of $Z_{out}/2 \leq Z_2 \leq 2*Z_{out}$.

The phase adjustment unit is achieved by a phase adjustment line whose length from the input branch unit to the output branch unit is $\lambda/2$ or an integral multiple of $\lambda/2$.

At least one of the distribution line or the phase adjustment unit includes one or more structures that connect different planes, and the input branch unit and the coupling terminal are located on different planes.

The input branch unit and the coupling terminal are on the same vertical line, and the distribution line, the phase adjustment unit, and the isolation resistor are arranged n times symmetrically about the vertical line.

A synthesizer according to another aspect of the present technology is formed on a substrate and includes: an input branch unit that is connected to an external transmission line on an input side, and divides each of n paths into an internal side and a synthesis line; an output synthesis unit that synthesizes synthesis lines divided for each of the n paths, and is connected to an external transmission line on an output side; a coupling terminal that couples the n paths on the internal side; and a phase adjustment unit that is arranged between the input branch unit and the coupling terminal so as to be connected in series with a resistor, and adjusts a phase, in which a phase rotation amount from the input branch unit to the output synthesis unit of each of the n paths is $\pi/2$ [rad], and a phase rotation amount from the input branch unit to the coupling terminal is $\pi$[rad] or a real number multiple of $\pi$[rad].

The phase adjustment unit is arranged between the input branch unit and the resistor.

The phase adjustment unit is arranged between the resistor and the coupling terminal.

The phase adjustment unit includes a first phase adjustment unit connected to the input branch unit, and a second phase adjustment unit connected to the coupling terminal, and the resistor is arranged between the first phase adjustment unit and the second phase adjustment unit.

When input impedance is $Z_{in}$, output impedance is $Z_{out}$, and distribution number is n, characteristic impedance $Z_1$ of the synthesis line is designed as $\sqrt{(n\ Z_{in}\ Z_{out})}$, and a resistance value R of the resistor is designed as $Z_{out}$.

Characteristic impedance $Z_2$ of the phase adjustment unit is designed to be in a range of $Z_{out}/2 \leq Z_2 \leq 2*Z_{out}$.

The phase adjustment unit is achieved by a phase adjustment line whose length from the input branch unit to the output synthesis unit is $\lambda/2$ or an integral multiple of $\lambda/2$.

At least one of the synthesis line or the phase adjustment unit includes one or more structures that connect different planes, and the output synthesis unit and the coupling terminal are located on different planes.

The output synthesis unit and the coupling terminal are on the same vertical line, and the synthesis line, the phase adjustment unit, and the resistor are arranged n times symmetrically about the vertical line.

In an aspect of the present technology, the present technology is formed on a substrate and includes: an input branch unit connected to an external transmission line on an input side; a distribution line that re-distributes a path from the input branch unit; an output branch unit that is connected to an output side of the distribution line and divides n-distributed paths into an internal side and the external transmission line on the output side; a coupling terminal that couples the re-distributed paths on the internal side; and a phase adjustment unit that is arranged between the output branch unit and the coupling terminal so as to be connected in series with a resistor, and adjusts a phase. At that time, the phase rotation amount from the input branch unit to the output branch unit of each of the n-distributed paths is $\pi/2$ [rad], and the phase rotation amount from the output branch unit to the coupling terminal is $\pi$[rad] or a real number multiple of $\pi$[rad].

In another aspect of the present technology, the present technology is formed on a substrate and includes: an input branch unit that is connected to an external transmission line on an input side, and divides each paths into an internal side and a synthesis line for each of n paths; an output synthesis unit that synthesizes synthesis lines divided for each n paths, and is connected to an external transmission line on an output side; a coupling terminal that couples the n paths on the internal side; and a phase adjustment unit that is arranged between the input branch unit and the coupling terminal so as to be connected in series with a resistor, and adjusts a phase. At that time, the phase rotation amount from the input branch unit to the output synthesis unit of each of n is $\pi/2$ [rad], and the phase rotation amount from the input branch unit to the coupling terminal is $\pi$[rad] or a real number multiple of $\pi$[rad].

Effects of the Invention

According to the present technology, particularly, downsizing and low loss can be achieved.

Note that the effects described herein are merely illustrative, effects of the present technology are not limited to the effects described herein, and the present technology may have additional effects.

MODE FOR CARRYING OUT THE INVENTION

Figure 1:
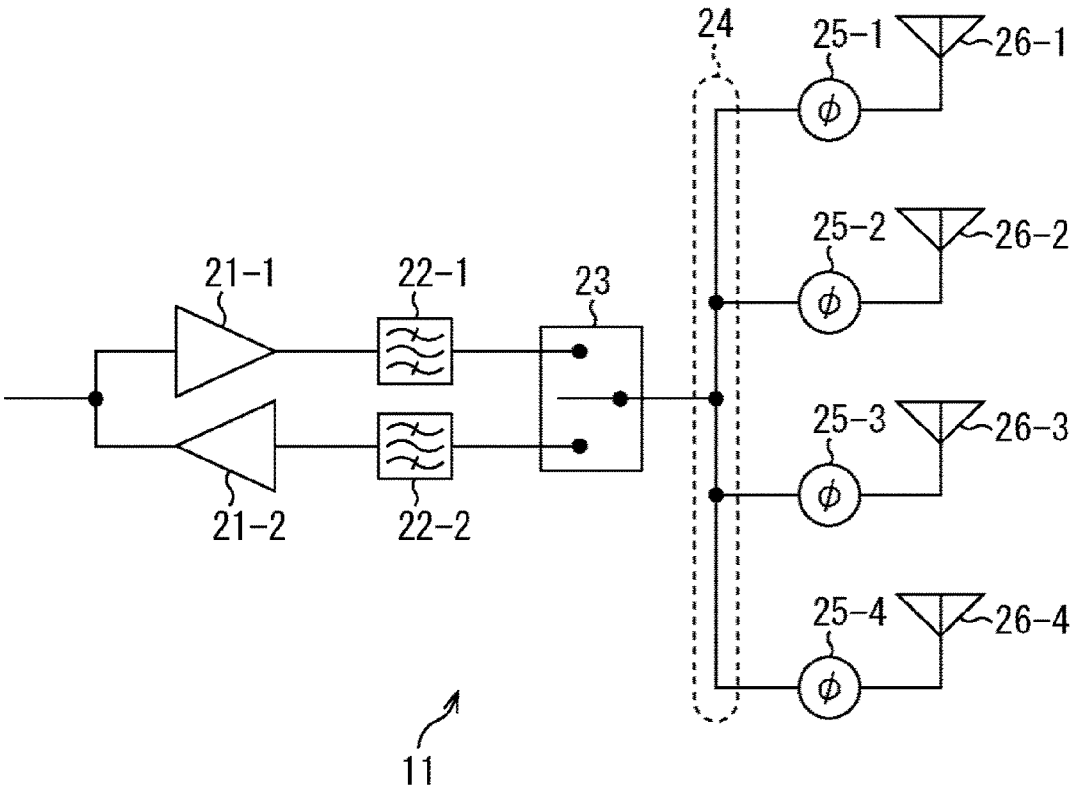
FIG. 1 is a block diagram showing a configuration example of a transmission and reception unit in a signal processing device to which the present technology is applied.

Hereinafter, modes (hereinafter referred to as embodiments) for implementing the present disclosure will be described. The description will be given in the following order.

1. Some configuration examples of signal processing device
2. Configuration example of distributor/synthesizer
3. First structure example of distributor/synthesizer
4. Simulation results
5. Second structure example of distributor/synthesizer
6. Third structure example of distributor/synthesizer
7. Fourth structure example of distributor/synthesizer
8. Configuration example of phase adjustment unit <Some Configuration Examples of Signal Processing Device>

FIG. 1 shows a configuration example of a transmission and reception unit in a signal processing device to which the present technology is applied.

FIG. 1 shows a configuration example of a transmission and reception unit 11 that is a front end module (FEM) in a signal processing device. The transmission and reception unit 11 includes amplifiers 21-1 and 21-2, filters 22-1 and 22-2, a switch 23, a distributor/synthesizer 24, phase shifters 25-1 to 25-4, and antennas 26-1 to 26-4.

The amplifier 21-1 amplifies a signal from a signal processing unit and outputs the amplified signal to the filter 22-1. The amplifier 21-2 amplifies a signal from the filter 22-2 and outputs the amplified signal to a signal processing unit (not shown).

The filter 22-1 performs filter processing on the signal from the amplifier 21-1, and outputs the filtered signal to the switch 23. The filter 22-2 performs filter processing on the signal from the distributor/synthesizer 24 input via the switch 23, and outputs the filtered signal to the amplifier 21-2.

At the time of signal transmission, the switch 23 selects a terminal on the filter 22-1 side and outputs a signal from the terminal on the filter 22-1 side to the distributor/synthesizer 24. Furthermore, at the time of receiving a signal, the switch 23 selects a terminal on the filter 22-2 side, and outputs a signal from the distributor/synthesizer 24 to a terminal on the filter 22-2 side.

The distributor/synthesizer 24 synthesizes the signals from the phase shifters 25-1 to 25-4 and outputs the synthesized signals to the switch 23. Furthermore, the distributor/synthesizer 24 distributes the signal from the switch 23 and outputs the signal to the phase shifters 25-1 to 25-4.

Each of the phase shifters 25-1 to 25-4 performs phase shift for matching the phases of the signals from the antennas 26-1 to 26-4, respectively, and outputs the phase-shifted signals to the distributor/synthesizer 24. Each of the phase shifters 25-1 to 25-4 performs phase shift for slightly shifting the phase of the signal from the distributor/synthesizer 24, and outputs the phase-shifted signal to the antennas 26-1 to 26-4.

The antennas 26-1 to 26-4 are omnidirectional antennas and constitute a four-element antenna array. Each of the antennas 26-1 to 26-4 receives, for example, a signal from a radio wave base station, and outputs the received signal to the phase shifters 25-1 to 25-4. Furthermore, the antennas 26-1 to 26-4 transmit signals from the phase shifters 25-1 to 25-4 to the radio wave base station, respectively.

Note that, in the example of FIG. 1, an example of four elements is shown, but other numbers of elements such as eight elements may be used. Furthermore, in the example of FIG. 1, the filters 22-1 and 22-2 are arranged between the amplifiers 21-1 and 21-2 and the switch 23, but the filters 22-1 and 22-2 may be arranged between the distributor/synthesizer 24 and the phase shifters 25-1 and 25-4.

In the following description, the amplifiers 21-1 and 21-2 are collectively referred to as the amplifier 21, and the filters 22-1 and 22-2 are collectively referred to as the filter 22 in a case where it is not particularly necessary to distinguish between them. Furthermore, the phase shifters 25-1 to 25-4 are collectively referred to as a phase shifter 25, and the antennas 26-1 to 26-4 are collectively referred to as an antenna 26.

<Configuration Example of Distributor/Synthesizer>

Figure 2:
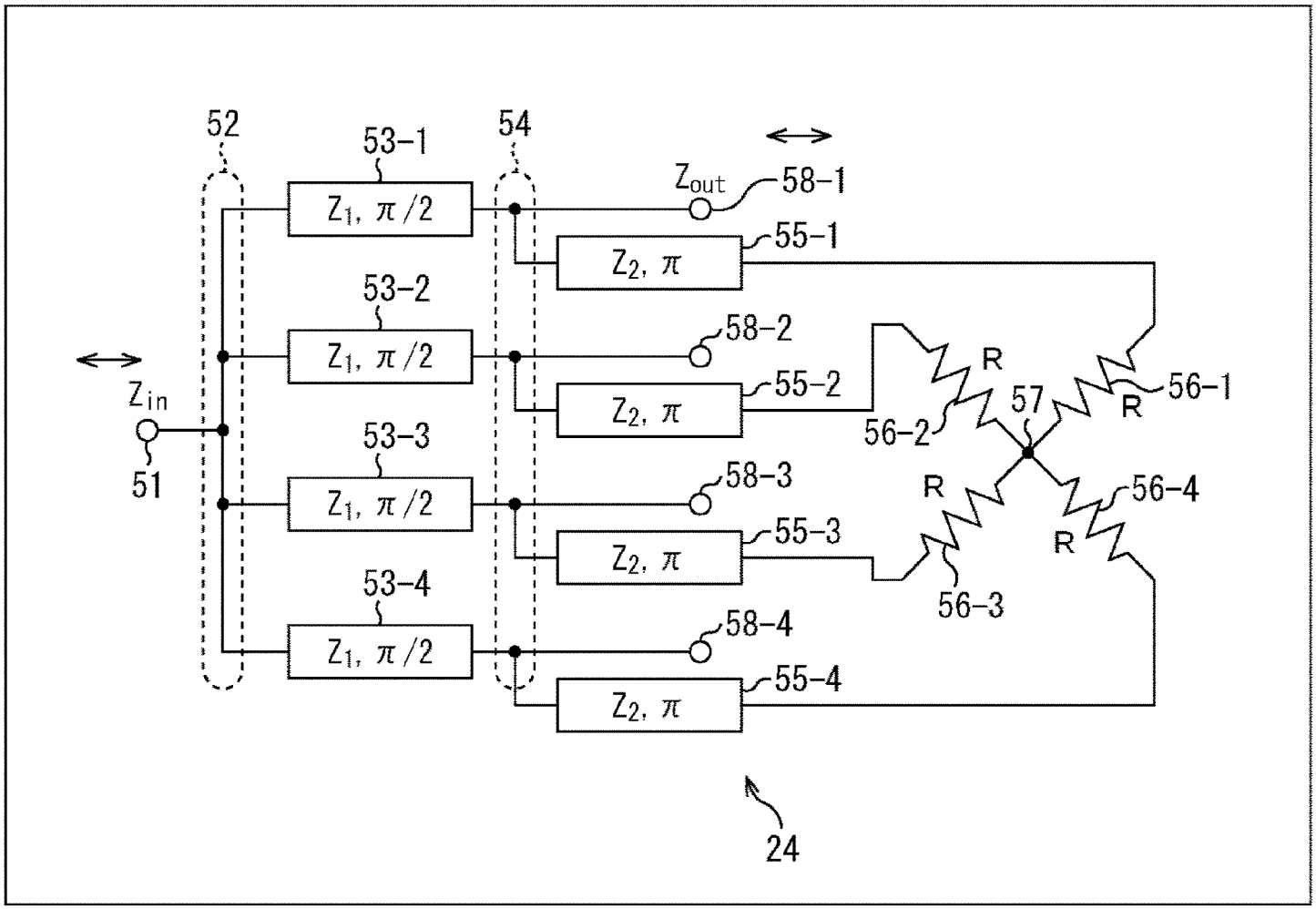
FIG. 2 is an equivalent circuit diagram showing a first configuration example of a distributor/synthesizer.

FIG. 2 is an equivalent circuit diagram showing a first configuration example of the distributor/synthesizer 24.

Hereinafter, an example of signal distribution will be described. Note that, in the case of synthesis, the signal flow is reversed, and the input side and output side are opposite to those in the case of distribution.

The distributor/synthesizer 24 is formed on the substrate. The distributor/synthesizer 24 includes an input and output terminal 51, an input branch unit 52, distribution lines 53-1 to 53-4, an output branch unit 54, phase adjustment units 55-1 to 55-4, isolation resistors 56-1 to 56-4, a coupling terminal 57, and input and output terminals 58-1 to 58-4.

Hereinafter, in a case where it is not particularly necessary to distinguish between them, the distribution lines 53-1 to 53-4 are collectively referred to as the distribution line 53, and the phase adjustment units 55-1 to 55-8 are collectively referred to as the phase adjustment unit 55 as appropriate. The input and output terminals 58-1 to 58-8 are collectively referred to as the input and output terminal 58.

The input and output terminal 51 inputs a signal from an external transmission line on the input side connected to the switch 23 to the input branch unit 52. The characteristic impedance at the input and output terminal 51 is defined as input impedance $Z_{in}$.

The input branch unit 52 connects the external transmission line on the input side and the distribution lines 53-1 to 53-4.

The distribution lines 53-1 to 53-4 distribute paths from the input branch unit 52 into four. "$Z_1$, $\pi/2$" shown in the blocks of the distribution lines 53-1 to 53-4 in FIG. 2 represents the characteristic impedance $Z_1$ and the phase rotation amount $\pi/2$ [rad] of the distribution lines 53-1 to 53-4, respectively. Actually, the phase rotation amount of the distribution lines 53-1 to 53-4 represents the phase rotation amount on the path from the input branch unit 52 to the output branch unit 54.

The output branch unit 54 is connected to the output side of the distribution lines 53-1 to 53-4 and divides the four-distributed paths into an internal path and an output external transmission line. The internal path represents a path connected to the phase adjustment units 55-1 to 55-4, the isolation resistors 56-1 to 56-4, and the coupling terminal 57.

In the internal path, the phase adjustment units 55-1 to 55-4 are arranged in front of the isolation resistors 56-1 to 56-4, respectively, and are connected in series with the isolation resistors 56-1 to 56-4.

"$Z_2$, n" shown in the blocks of the phase adjustment units 55-1 to 55-4 in FIG. 2 represents the characteristic impedance $Z_2$ and the phase rotation amount n [rad] of the phase adjustment units 55-1 to 55-4, respectively (or a real number multiple of $\pi$[rad]). Actually, the phase rotation amount of the phase adjustment units 55-1 to 55-4 represents the phase rotation amount on the path from the output branch unit 54 to the coupling terminal 57.

The isolation resistors 56-1 to 56-4 are resistors for obtaining inter-terminal isolation characteristics. Note that the type of isolation resistor may be any type such as a chip resistor or a thin film resistor.

Terminals on one side of the isolation resistors 56-1 to 56-4 are connected to the phase adjusters 55-1 to 55-4, respectively, and the other terminals are connected to the common coupling terminal 57.

The coupling terminal 57 couples internal paths each connected to the isolation resistors 56-1 to 56-4.

The input and output terminals 58-1 to 58-4 output signals from the output branch unit 54 to external transmission lines connected to the antennas 26-1 to 26-4, respectively. The characteristic impedance at the input and output terminals 58-1 to 58-4 is defined as an output impedance $Z_{out}$.

Note that, in the above description, it has been described that the phase rotation amounts of the phase adjustment units 55-1 to 55-4 are $\pi$[rad] or real number multiples of $\pi$[rad], respectively. Specifically, each phase rotation amount of the total of one phase adjustment unit, one isolation resistor, and half the size of the coupling terminal 57 (viewed from above), that is, on the path from the branch point of the output branch unit 54 indicated by the black dot to the coupling element 57 is $\pi$[rad] or a real number multiple of n [rad].

Furthermore, the distributor including the input and output terminal 51, the input branch unit 52, the distribution lines 53-1 to 53-4, the output branch unit 54, the isolation resistors 56-1 to 56-4, the coupling terminal 57, and the input and output terminal 58 is a Wilkinson distributor.

In other words, the distributor/synthesizer 24 is obtained by adding phase adjustment units 55-1 to 55-4 that rotate the phase by $\pi$[rad] or a real number multiple of $\pi$[rad], in series with the isolation resistors 56-1 to 56-4 of the Wilkinson distributor.

Here, when input impedance is $Z_{in}$, output impedance is $Z_{out}$, and the distribution number is n, characteristic impedance $Z_1$ of the distribution line 53 is designed as ($n\,Z_{in}\,Z_{out}$). Furthermore, the resistance value R of the isolation resistor 56 is designed as $Z_{out}$.

Note that each characteristic impedance $Z_2$ of the phase adjustment units 55-1 to 55-4 may take any value, but it affects the frequency band and wiring area, so that it is necessary to adjust the characteristic impedance $Z_2$ according to the input and output impedance and the distribution number. By setting the characteristic impedance $Z_2$ of the phase adjustment units 55-1 to 55-4 to a value that satisfies the condition of $Z_{out}/2 \leq Z_2 \leq 2*Z_{out}$, the bandwidth with the fractional bandwidth of about 10% (−20 dB width) can be secured. The fractional bandwidth is a frequency resource and is a ratio of the bandwidth to the center frequency.

Note that, as described above, in the case of synthesis, the signal flow is reversed, and the input side and the output side are opposite to those in the case of distribution. In other words, the input and output terminal 51 is an output side terminal, and the input and output terminals 58-1 to 58-4 are input side terminals.

The output branch unit 54 is an input branch unit, the distribution line 53 is a synthesis line, and the input branch unit 52 is an output synthesis unit.

In other words, as to the configuration in the case of synthesis by showing the role in the case of synthesis in parentheses, the output branch unit (input branch unit) 54 is connected to the external transmission line on the input side via the input and output terminal 58. The output branch unit (input branch unit) 54 is divided into an internal path and a distribution line (synthesis line) 53 for each of the n paths.

The input branch unit (output synthesis unit) 52 is connected to the output side of the distribution line (synthesis line) 53 distributed for each of the n paths, and is connected to the external transmission line on the output side via the input and output terminal 51.

In the internal path, the coupling terminal 57 couples n paths. The phase adjustment unit 55 is arranged between the output branch unit (input branch unit) 54 and the coupling terminal 57 so as to be connected in series with the isolation resistor 56, and adjusts the phase.

Other configurations are similar to the case of the distribution. Also in the case of synthesis, the phase rotation amount on the path from the output branch unit (input branch unit) 54 to the input branch unit (output synthesis unit) 52 is $\pi/2$ [rad] for each of the n paths. Furthermore, the phase rotation amount on the path from the output branch unit (input branch unit) 54 to the coupling terminal 57 is $\pi$[rad] or a real number multiple of $\pi$[rad].

Note that, in FIG. 2, the example has been described in which the phase adjustment units 55 are each arranged in the preceding stage of the isolation resistors 56 with the input and output terminal 51 side as the front and the coupling terminal 57 side as the back. However, in the arrangement of FIG. 2, it may be difficult to connect the four isolation resistors 56 to the common coupling terminal 57 in a case where the isolation resistors 56 are wide.

Figure 3:
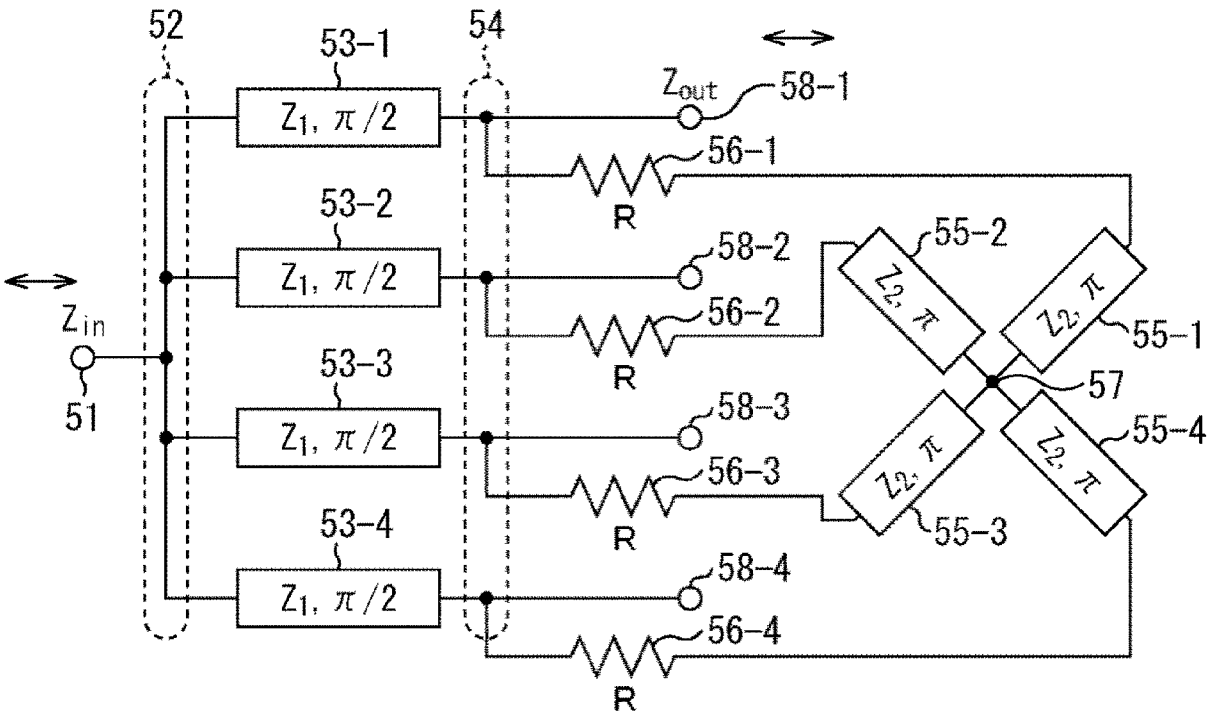
FIG. 3 is an equivalent circuit diagram showing a second configuration example of a distributor/synthesizer.

Therefore, as shown in the example of the next FIG. 3, the phase adjustment unit 55 may be arranged not in the preceding stage of the isolation resistor 56 but in the subsequent stage of the isolation resistor 56.

FIG. 3 is an equivalent circuit diagram showing a second configuration example of the distributor/synthesizer 24.

The equivalent circuit diagram of FIG. 3 is the same as the equivalent circuit diagram of FIG. 2 except that the position of the phase adjustment unit 55 and the position of the isolation resistor 56 are different. The other configuration of the equivalent circuit diagram of FIG. 3 is similar to the configuration of the equivalent circuit of FIG. 2, and therefore only different parts will be described.

In the example of FIG. 3, the phase adjustment unit 55 connected in series with the isolation resistor 56 is arranged at the subsequent stage of the isolation resistor 56, unlike the case of FIG. 2.

The output branch unit 54 is connected to the output side of the distribution line 53 and divides the four-distributed paths into an internal path and an output external transmission line. The internal path represents a path connected to the isolation resistor 56, the phase adjustment unit 55, and the coupling terminal 57.

In the internal path, the isolation resistor 56 is arranged in the preceding stage of the phase adjustment unit 55 and is connected in series with the phase adjustment unit 55.

One terminal of the phase adjustment unit 55 is connected to the isolation resistor 56, and the other terminal is connected to the common coupling terminal 57. "$Z_2$, $\pi$" shown in the blocks of the phase adjustment unit 55 in FIG. 3 represents the characteristic impedance $Z_2$ and the phase rotation amount $\pi$[rad] (or a real number multiple of $\pi$[rad]) of the phase adjustment unit 55.

With the configuration as shown in FIG. 3, it is not necessary to connect the four isolation resistors 56 to the common coupling terminal 57, and mounting becomes easy. However, in a case where the width of the isolation resistor 56 is wide, if the arrangement of FIG. 3 is taken, the width of the output branch unit 54 becomes wide, which may adversely affect the characteristics of the distributor/synthesizer 24.

Figure 4:
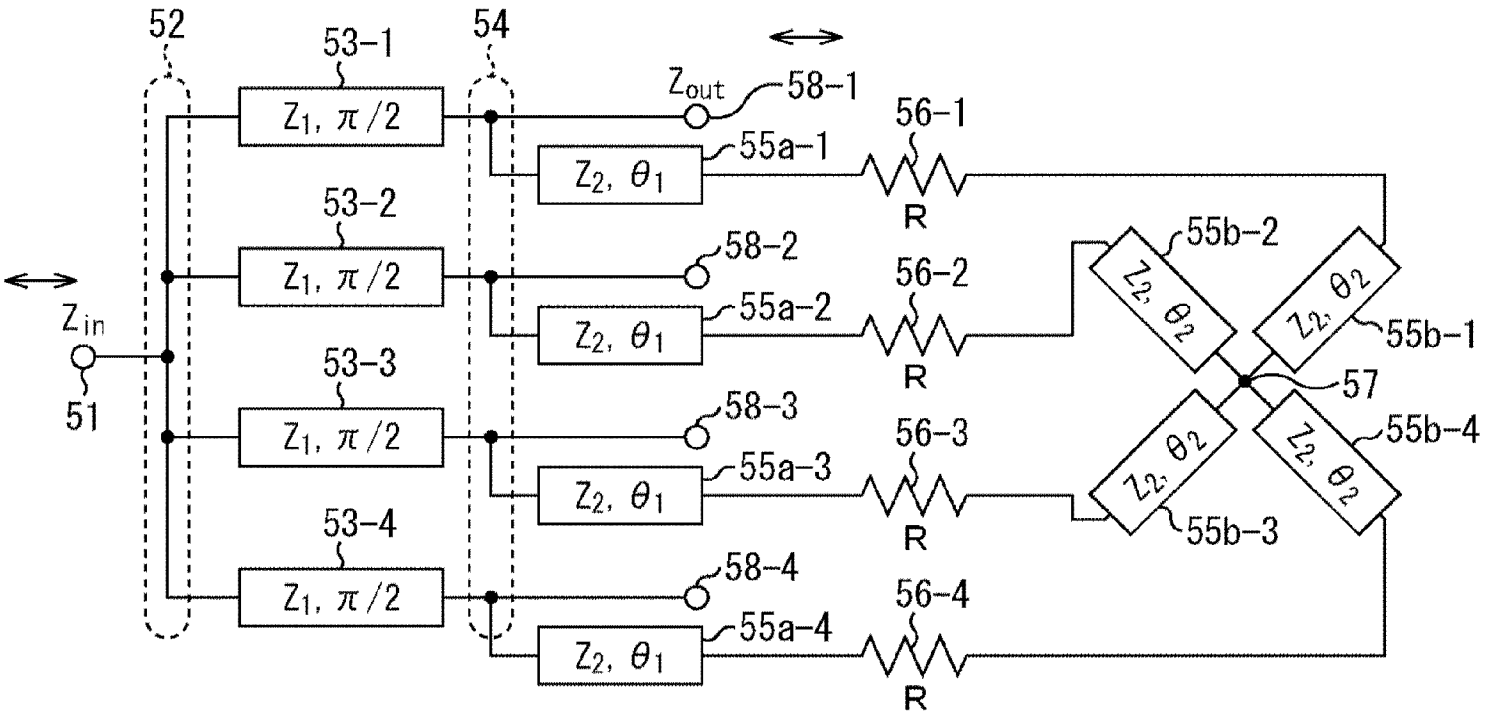
FIG. 4 is an equivalent circuit diagram showing a third configuration example of a distributor/synthesizer.

Therefore, as shown in the example of FIG. 4 below, the isolation resistor 56 may be arranged in the middle of the phase adjustment unit 55.

FIG. 4 is an equivalent circuit diagram showing a third configuration example of the distributor/synthesizer 24.

The equivalent circuit diagram of FIG. 4 is different from the equivalent circuit diagram of FIG. 2 in that the phase adjustment units 55-1 to 55-4 include phase adjustment units **55*a*-1 to 55*a*-4 and phase adjustment units 55*b*-1 to 55*b*-4. Furthermore, the equivalent circuit diagram of FIG. 4 is different from the equivalent circuit diagram of FIG. 2 in that the isolation resistors 56-1 to 56-4 are arranged between the phase adjustment units 55*a*-1 to 55*a*-4 and the phase adjustment units 55*b*-1 to 55*b*-4. Since the other configuration of the equivalent circuit diagram of FIG. 4 is similar to the configuration of the equivalent circuit of FIG. 2**, only different portions will be described.

Hereinafter, the phase adjustment units **55*a*-1 to 55*a*-4 are collectively referred to as a phase adjustment unit 55*a*, and the phase adjustment units 55*b*-1 to 55*b*-4 are collectively referred to as a phase adjustment unit 55*b***, in a case where it is not particularly necessary to distinguish them.

The output branch unit 54 is connected to the output side of the distribution line 53 and divides the four-distributed paths into an internal path and an output external transmission line. The internal path represents a path connected to the phase adjustment unit **55*a*, the isolation resistor 56, the phase adjustment unit 55*b*, and the coupling terminal 57**.

In the internal path, the phase adjustment unit **55*a* is arranged in the preceding stage of the isolation resistor 56. The phase adjustment unit 55*b* is arranged in the subsequent stage of the isolation resistor 56**.

The phase adjustment unit **55*a*, the isolation resistor 56, and the phase adjustment unit 55*b* are connected in series. Each of the characteristic impedances of the phase adjustment unit 55*a* and the phase adjustment unit 55*b*** is characteristic impedance $Z_2$.

"$Z_2$, $\theta_1$" shown in the blocks of the phase adjustment unit **55*a* in FIG. 4 represents the characteristic impedance $Z_2$ and the phase rotation amount $\theta_1$ [rad] of the phase adjustment unit 55*a***.

"$Z_2$, $\theta_2$" shown in the block of the phase adjustment unit **55*b* in FIG. 4 represents the characteristic impedance $Z_2$ and the phase rotation amount $\theta_2$ [rad] of the phase adjustment unit 55*b*. One terminal of the phase adjustment unit 55*b* is connected to the isolation resistor 56, and the other terminal is connected to the common coupling terminal 57. Since the position of the isolation resistor 56 only needs to be between the phase adjustment units 55***a* and 55*b*, either of the phase rotation amounts $\theta_1$ and $\theta_2$ may be large.

Note that, since FIG. 4 shows an equivalent circuit, the isolation resistor 56 is described as a lumped constant terminal having no size. The equivalent circuit of FIG. 4 is actually π[rad] or a real number multiple of π[rad] including the phase rotation amount of the size of the resistance value R of the isolation resistor 56.

With the configuration as shown in FIG. 4, it is possible to improve the characteristics of the distributor/synthesizer 24 generated when the output branch unit 54 is wide.

As described above, as the configuration of the distributor/synthesizer 24, various configurations can be selected according to the size of the isolation resistor 56 or the arrangement method of the phase adjustment unit 55.

First Structure Example of Distributor/Synthesizer

Next, the first structure of the distributor/synthesizer 24 will be described with reference to FIGS. 5 and 6.

Figure 5:
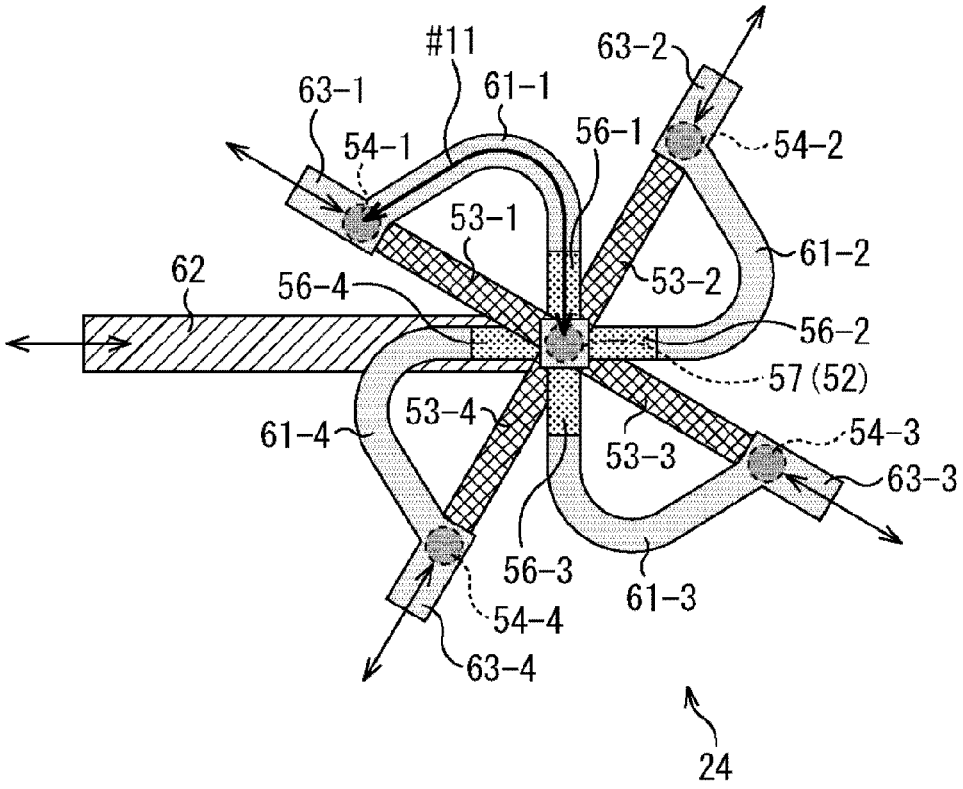
FIG. 5 is a plan view showing a first structure example of a distributor/synthesizer.

FIG. 5 is a plan view schematically showing a structure example of the distributor/synthesizer 24. FIG. 6 is a plan view schematically showing an example of the layer structure of the distributor/synthesizer 24. The same reference numerals are added to the same configurations as the above configurations, in the configurations shown in FIGS. 5 and 6. This is similar in FIG. 11 and subsequent drawings as described later.

Figure 6:
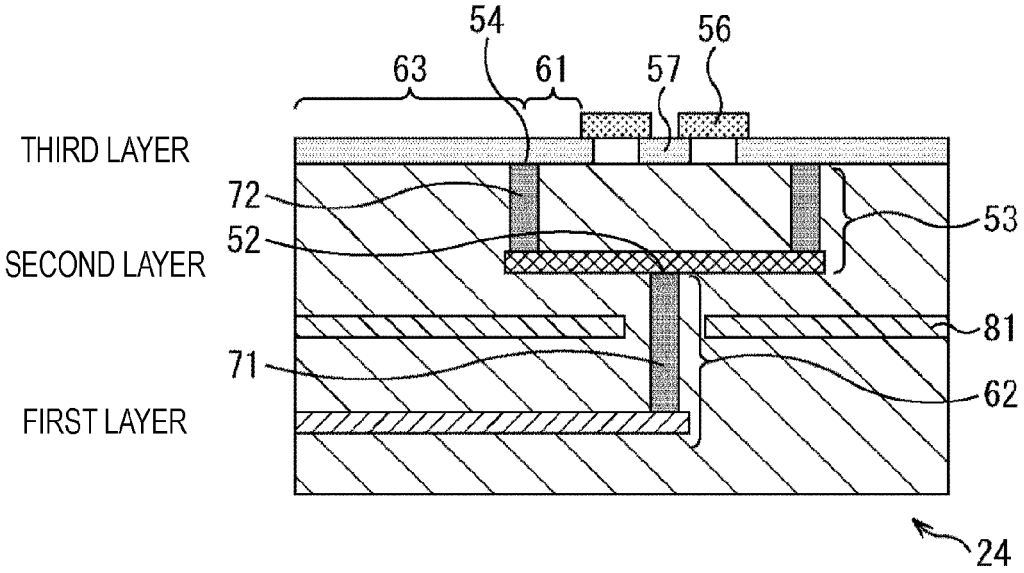
FIG. 6 is a cross-sectional view showing the first structure example of a distributor/synthesizer.

FIGS. 5 and 6 show an example in which the distributor/synthesizer 24 is configured as a quadrant distributor/synthesizer having a multilayer substrate structure including three wiring layers constituting the first to third layers and one GND layer 81 in order from the bottom. The GND layer 81 is provided between the first layer and the second layer.

In the example of FIGS. 5 and 6, the phase adjustment units 55-1 to 55-4 are configured as phase adjustment lines 61-1 to 61-4. Furthermore, the external transmission line connected to the input and output terminal 51 is configured as an input transmission line 62, and the external transmission lines connected to the input and output terminals 58-1 to 58-4 are configured as output transmission lines 63-1 to 63-4.

Each wiring is achieved by, for example, a copper pattern on a flame retardant type 4 (FR4) substrate. A VIA is used for wiring connection between layers.

Hereinafter, the phase adjustment lines 61-1 to 61-4 are collectively referred to as the phase adjustment line 61, and the output transmission lines 63-1 to 63-4 are collectively referred to as the output transmission line 63 in a case where it is not particularly necessary to distinguish them.

In the example of FIG. 5, the input branch unit 52 and the coupling terminal 57 are arranged at the same position in different layers. The phase adjustment line 61 is configured to connect from the input branch unit 52 to the output branch unit 54 by a substantially parabolic path such that the length from the input branch unit 52 to the output branch unit 54 is λ/2 or an integral multiple thereof, where A is the wavelength of the signal.

Note that, in the distributor/synthesizer 24, it is formed such that the phase rotation amount in the path indicated by the arrow #11 from the output branch unit 54 to the coupling terminal 57 including the phase adjustment line 61 and the isolation resistor 56 is n [rad] or a real number multiple of π[rad].

In the cross-sectional structure of FIG. 6, a part of the path of the input transmission line 62 is arranged in the first layer which is the lowest layer. The input transmission line 62 is configured by a part of the path arranged in the first layer and the VIA 71. The input transmission line 62 is connected to the distribution line 53 of the second layer at the input branch unit 52 via the VIA 71.

In the second layer, a part of the path of the distribution line 53 is arranged. The distribution line 53 is configured by a part of the path arranged in the second layer and the VIA 72. The distribution line 53 is connected to the phase adjustment line 61 and the output transmission line 63 of the third layer at the output branch unit 54 via the VIA 72.

In the third layer which is the uppermost layer, the output transmission line 63, the phase adjustment line 61, the coupling terminal 57, and the isolation resistor 56 are arranged.

As described above, at least one of the distribution line 53 or the phase adjustment line 61 includes one or more structures (such as VIA) that connect different planes (layers). Furthermore, the input branch unit 52 and the coupling terminal 57 are located on different planes (layers).

As shown in FIG. 6, the input branch unit 52 and the coupling terminal 57 are on the same vertical line. Furthermore, as shown in FIG. 5, the distribution lines 53-1 to 53-4, the phase adjustment lines 61-1 to 61-4, and the isolation resistors 56-1 to 56-4 are arranged four times symmetrically with the vertical line as an axis. Note that n-times symmetry means an arrangement that has the same shape even when rotated 360/n°.

Figure 7:
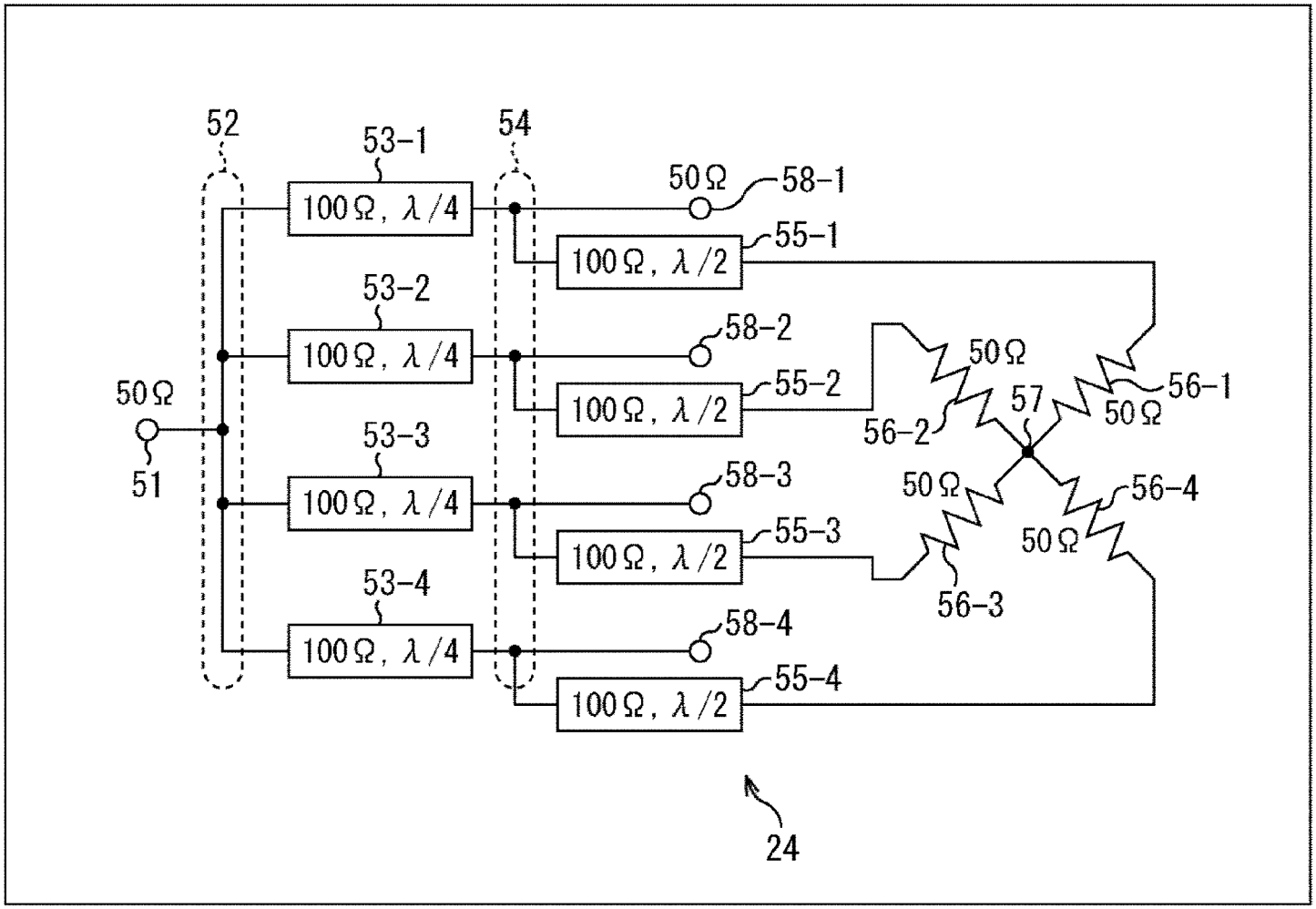
FIG. 7 is an equivalent circuit diagram showing a configuration example of the distributor/synthesizer in FIG. 5.

FIG. 7 is an equivalent circuit diagram of the distributor/synthesizer 24 in the case of taking the configuration of FIGS. 5 and 6.

Here, as shown in FIG. 7, the input and output impedance is 50Ω, and the characteristic impedance of the distribution line 53 and the phase adjustment unit 55 as the phase adjustment line 61 is 100Ω. Furthermore, the resistance value of the isolation resistor 56 is 50Ω. In this case, assuming that the wavelength of the signal is λ, the path length from the input branch unit 52 to the output branch unit 54 is λ/4, and the path length from the output branch unit 54 to the coupling terminal 57 is λ/2.

For example, since λ/2 in a high frequency signal of about 30 GHz is about 2.5 mm on the FR4 substrate, a 0603 size (length 0.6 mm) high frequency chip resistor or the like can be used as the isolation resistor 56. A thin film resistance or ink resistance by vapor deposition may be used as the isolation resistor 56.

<Simulation Results>

Figure 8:
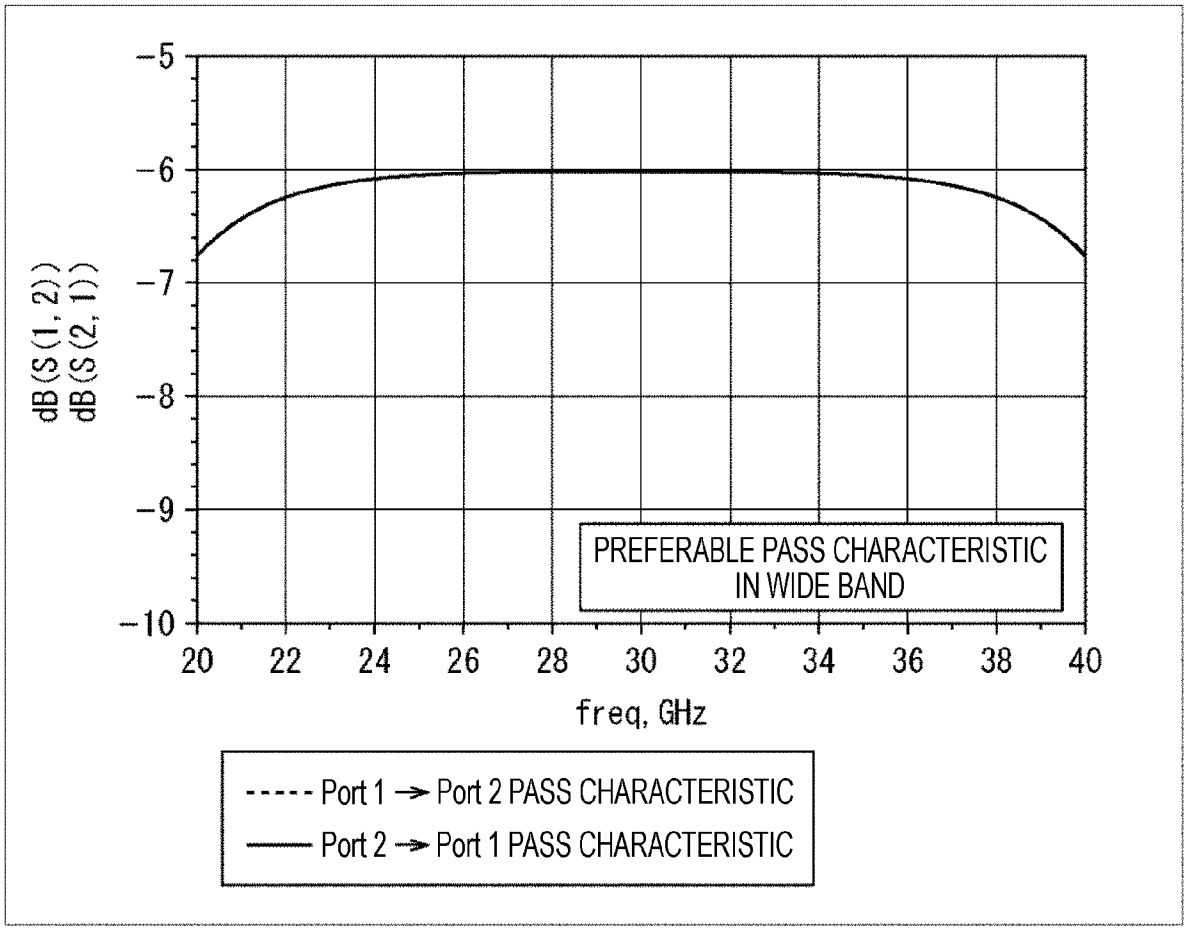
FIG. 8 is a diagram showing a simulation result.
Figure 9:
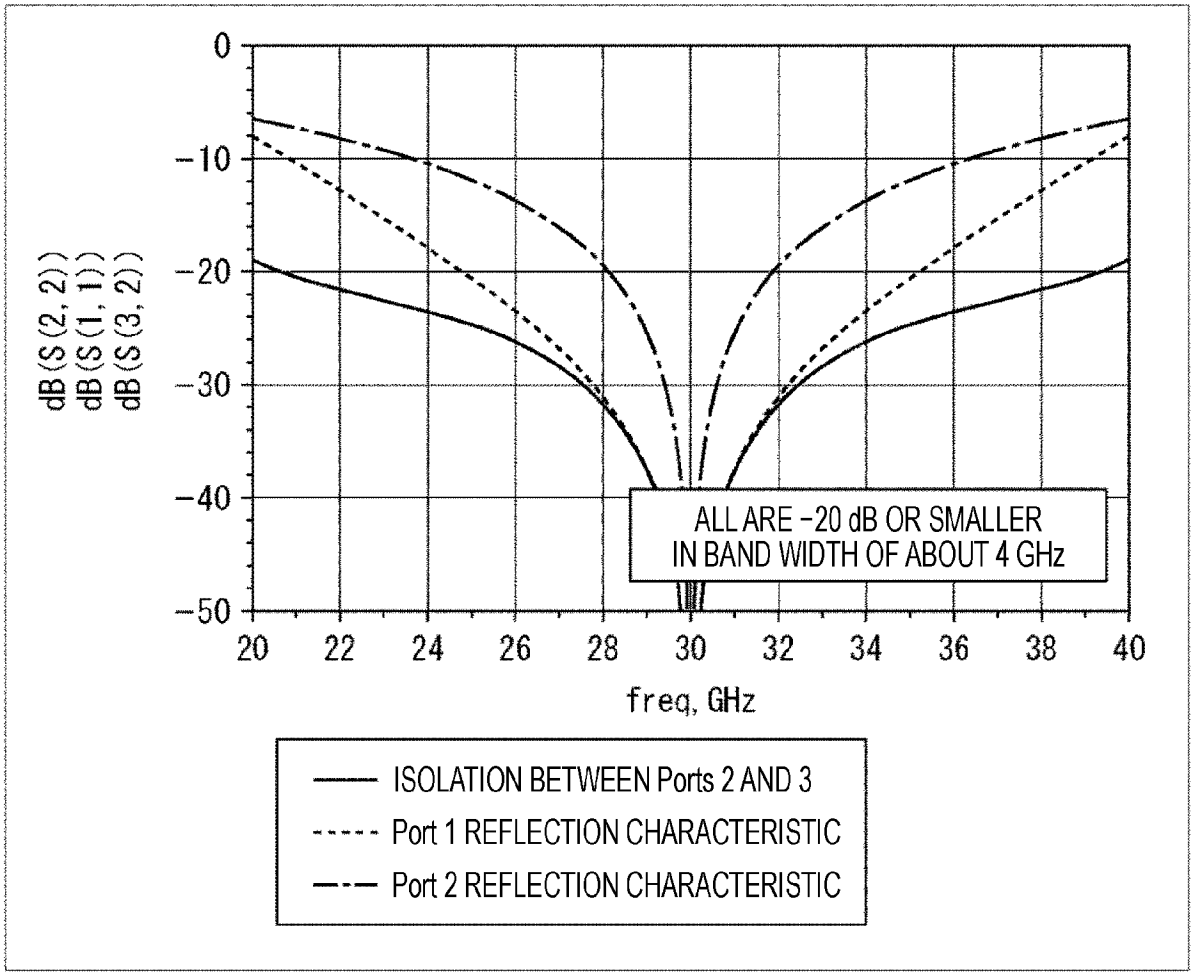
FIG. 9 is a diagram showing a simulation result.

FIGS. 8 and 9 are diagrams showing simulation results in the case of the equivalent circuit of FIG. 7.

In FIGS. 8 and 9, Port1, Port2, and Port3 correspond to the input and output terminal 51, the input and output terminal 58-1, and the input and output terminal 58-2, respectively.

In FIG. 8, the horizontal axis indicates the frequency, and the vertical axis indicates the pass characteristic of the signal of each frequency. In the example of FIG. 8, the pass characteristic at the frequency of the path passing through the input and output terminal 51 that is Port 1 to the input and output terminal 58-1 that is Port 2 is indicated by a broken line, and the pass characteristic at the frequency of the path passing through the input and output terminal 58-1 that is Port 2 to the input and output terminal 51 that is Port 1 is indicated by a solid line. The former pass characteristic indicated by the broken line overlaps the latter pass characteristic indicated by the solid line.

As shown in FIG. 8, the pass characteristics are almost flat in the band from 24 GHz to 36 GHz, and it can be seen that both pass characteristics during distribution and synthesis are preferable in a wide band.

In FIG. 9, the horizontal axis indicates the frequency, and the vertical axis indicates the characteristic of the signal of each frequency. In the example of FIG. 9, the isolation characteristic between Port2 and Port3 is indicated by a solid line. Furthermore, the reflection characteristic of Port1 is indicated by a broken line, and the reflection characteristic of Port2 is indicated by an alternate long and short dash line.

As shown in FIG. 9, it can be seen that all characteristics are −20 dB or less in a bandwidth of about 4 GHz centering on 30 GHz.

As shown in the above simulation results of FIGS. 8 and 9, the distributor/synthesizer 24 has necessary and sufficient characteristics as a quadrant distributor. Furthermore, the distributor/synthesizer 24 also has necessary and sufficient characteristics as a quadrant synthesizer.

Figure 10:
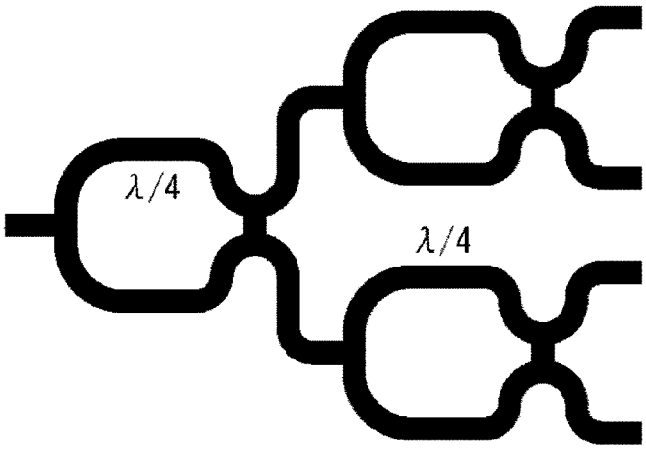
FIG. 10 is a diagram showing an example of a conventional quadrant distributor.

Moreover, in the conventional quadrant distributor shown in FIG. 10 arranged on the substrate, the length between the input and output is λ/2, but according to the present technology, the length of the input and output from the input branch unit 52 to the output branch unit 54 is λ/4, so that it can be said that the size is small and the loss is low.

In a case where the distribution number is increased, for example, to eight distributions, the path is further extended and the length between the input and output is 3λ/4 in the conventional eight-equal distributor arranged on the substrate. When the present technology is used, it is sufficient if the length is λ/4 as similar to the case of four-distribution.

Second Structure Example of Distributor/Synthesizer

Next, the second structure of the distributor/synthesizer 24 will be described with reference to FIGS. 11 and 12.

Figure 11:
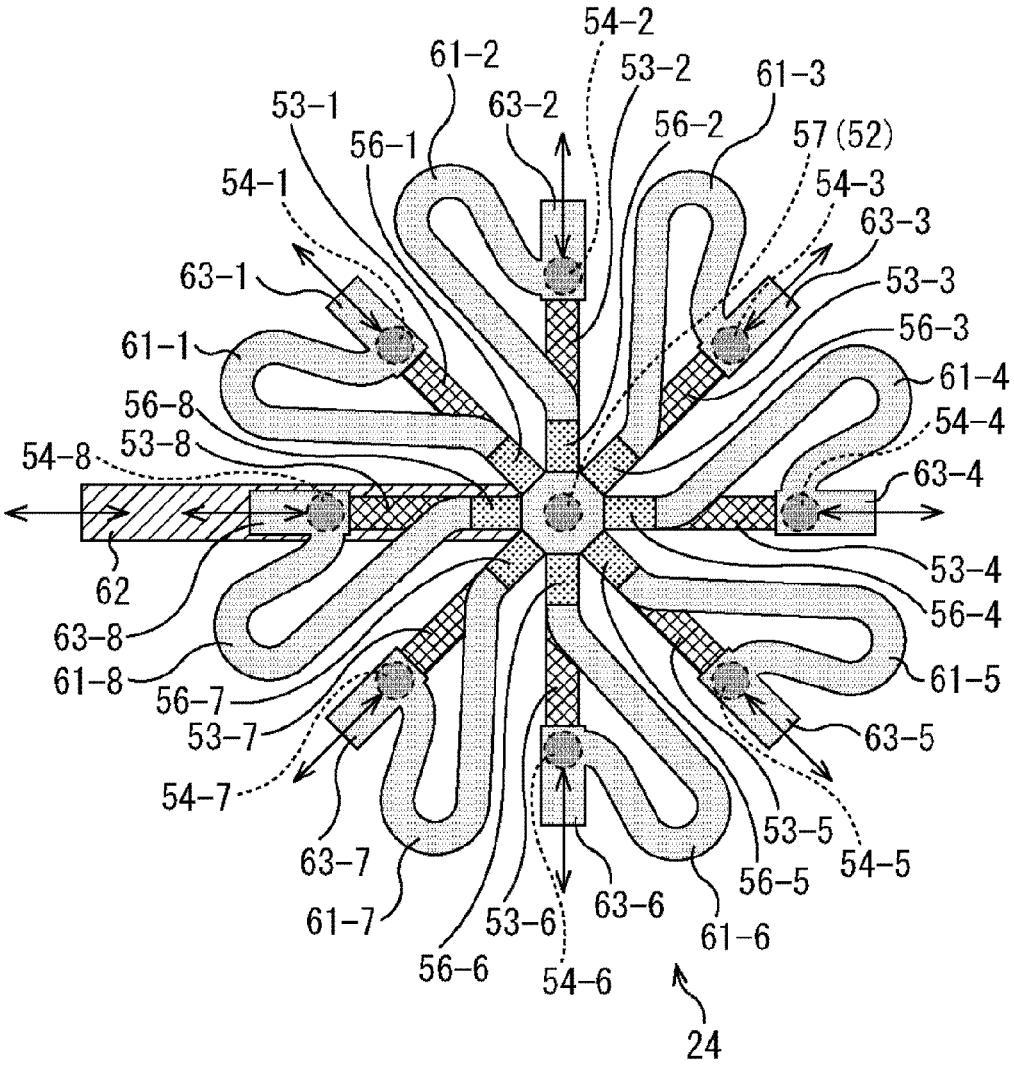
FIG. 11 is a plan view showing a second structure example of a distributor/synthesizer.

FIG. 11 is a plan view schematically showing a structure example of the distributor/synthesizer 24. FIG. 12 is a cross-sectional view schematically showing an example of the layer structure of the distributor/synthesizer 24.

Figure 12:
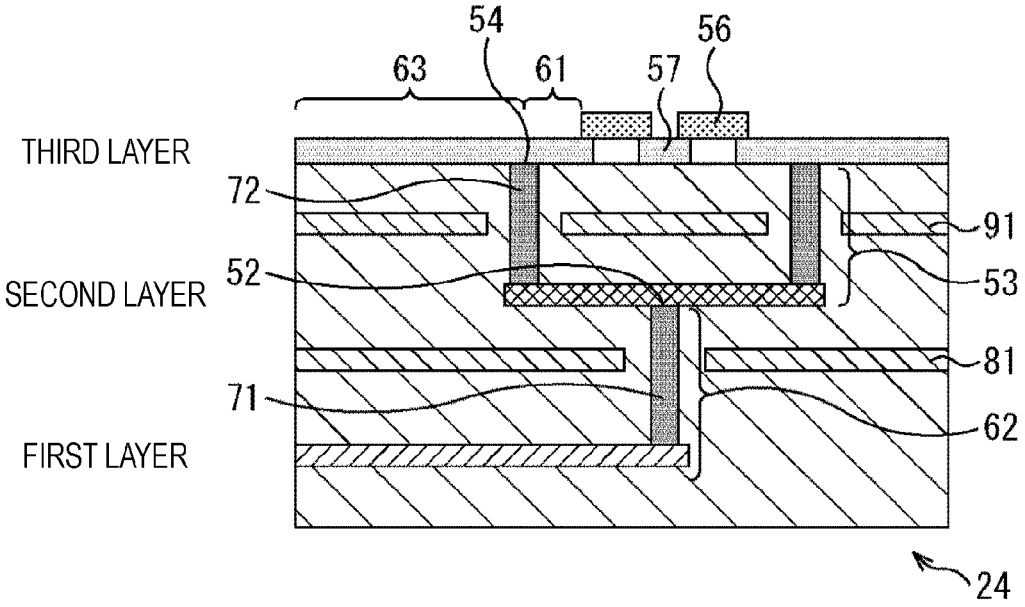
FIG. 12 is a cross-sectional view showing the second structure example of a distributor/synthesizer.

FIGS. 11 and 12 show an example in which the distributor/synthesizer 24 is configured as an eight-equal distributor/synthesizer having a multilayer substrate structure including three wiring layers constituting the first to third layers and two layers of GND layer 81 and GND layer 91 in order from the bottom. The GND layer 81 is provided between the first layer and the second layer. The GND layer 91 is provided between the second layer and the third layer.

In the example of FIGS. 11 and 12, the phase adjustment units 55-1 to 55-8 are configured as phase adjustment lines 61-1 to 61-8. Furthermore, the external transmission line connected to the input and output terminal 51 is configured as the input transmission line 62. The external transmission lines connected to the input and output terminals 58-1 to 58-8 are configured as output transmission lines 63-1 to 63-8.

Each wiring is achieved by, for example, a copper pattern on the FR4 substrate. Furthermore, a VIA is used for wiring connection between layers.

Hereinafter, the phase adjustment units 55-1 to 55-8 are collectively referred to as the phase adjustment unit 55, and the input and output terminals 58-1 to 58-8 are collectively referred to as the input and output terminal 58 in a case where it is not particularly necessary to distinguish them. The phase adjustment lines 61-1 to 61-8 are collectively referred to as the phase adjustment line 61, and the output transmission lines 63-1 to 63-8 are collectively referred to as the output transmission line 63.

In FIG. 11, the input branch unit 52 and the coupling terminal 57 are arranged at the same position in different layers. The phase adjustment line 61 is configured to connect from the input branch unit 52 to the output branch unit 54 by a substantially parabolic path such that the length from the input branch unit 52 the output branch unit 54 is λ/2 or an integral multiple thereof, where A is the wavelength of the signal.

In the cross-sectional structure of FIG. 12, a part of the path of the input transmission line 62 is arranged in the first layer which is the lowest layer. The input transmission line 62 is configured by a part of the path arranged in the first layer and the VIA 71. The input transmission line 62 is connected to the distribution line 53 of the second layer at the input branch unit 52 via the VIA 71.

In the second layer, a part of the path of the distribution line 53 is arranged. The distribution line 53 is configured by a part of the path arranged in the second layer and the VIA 72. The distribution line 53 is connected to the phase adjustment line 61 and the output transmission line 63 of the third layer at the output branch unit 54 via the VIA 72.

In the third layer which is the uppermost layer, the output transmission line 63, the phase adjustment line 61, the coupling terminal 57, and the isolation resistor 56 are arranged.

As described above, at least one of the distribution line 53 or the phase adjustment line 61 includes one or more structures (such as VIA) that connect different planes (layers), and the input branch unit 52 and the coupling terminal 57 are located on different planes (layers).

As shown in FIG. 12, the input branch unit 52 and the coupling terminal 57 are on the same vertical line. Furthermore, as shown in FIG. 11, the distribution lines 53-1 to 53-8, the phase adjustment lines 61-1 to 61-8, and the isolation resistors 56-1 to 56-8 are arranged eight times symmetrically with the vertical line as an axis.

In the case of FIGS. 11 and 12, when the input and output impedance is 50Ω, the characteristic impedance of the distribution line 53 matches in 141.4Ω, and the resistance value of the isolation resistor matches in 50Ω.

As described above, by providing the GND layer 91 between the second layer and the third layer wirings, the capacitive coupling between the second layer and the third layer wirings can be removed. As a result, the impedance of the wiring is stabilized, and a distributor/synthesizer with better characteristics can be achieved.

Furthermore, even if the wiring patterns of the second layer and the third layer overlap, impedance mismatch does not occur, so that configuration with a distribution number exceeding four divisions can be made easily.

Third Structure Example of Distributor/Synthesizer

Next, the third structure of the distributor/synthesizer 24 will be described with reference to FIGS. 13 and 14.

Figure 13:
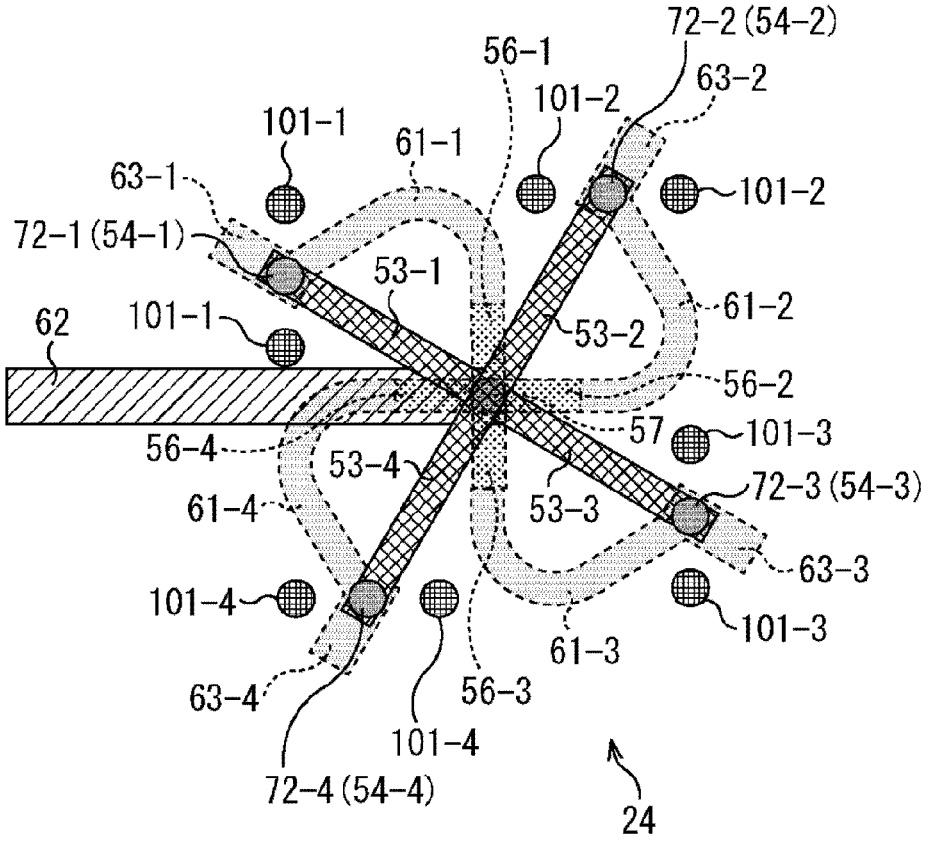
FIG. 13 is a plan view showing a third structure example of a distributor/synthesizer.

FIG. 13 is a plan view schematically showing a structure example of the distributor/synthesizer 24. FIG. 14 is a cross-sectional view schematically showing an example of the layer structure of the distributor/synthesizer 24.

Figure 14:
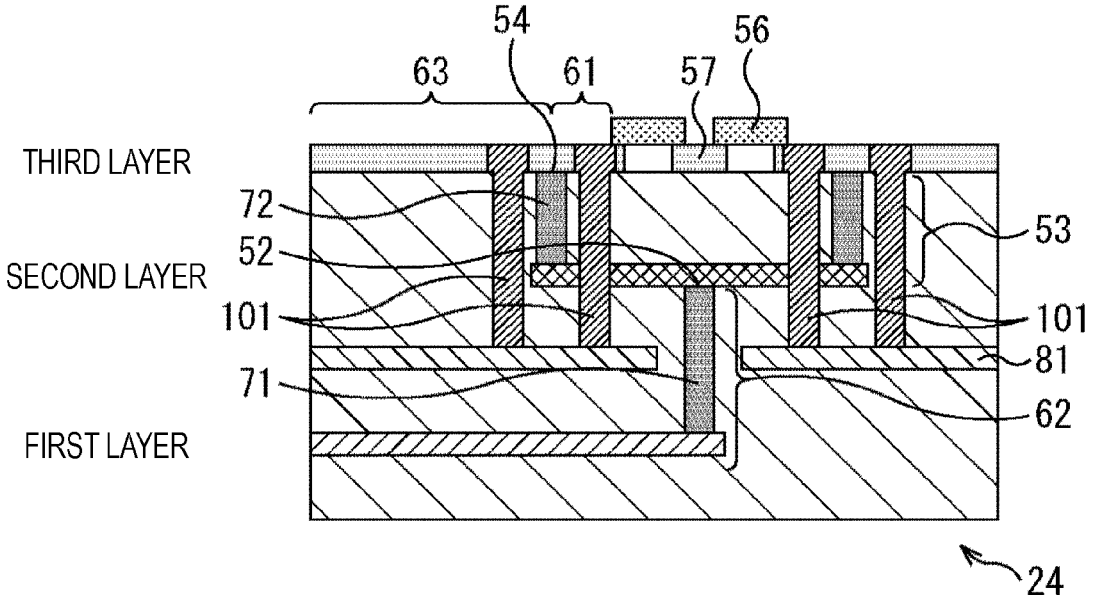
FIG. 14 is a cross-sectional view showing the third structure example of a distributor/synthesizer.

FIGS. 13 and 14 show an example in which a GND VIA (GROUND VIA) connected to the GND layer 81 is arranged in the vicinity of the VIA connecting the second layer and the third layer in the first structure of the distributor/synthesizer 24 of FIGS. 5 and 6. In the example of FIGS. 13 and 14, since the structure is the same as the first structure of FIGS. 5 and 6 except that the GND VIA is arranged, the description thereof is omitted.

As shown in FIG. 13, two GND VIA 101-1 are arranged at a position sandwiching the VIA 72-1 as the center. Two GND VIA 101-2 are arranged at a position sandwiching VIA 72-2 as the center. Two GND VIA 101-3 are arranged at a position sandwiching VIA 72-3 as the center. Two GND VIA 101-4 are arranged at a position sandwiching VIA 72-4 as the center.

By configuring as described above, impedance mismatch due to VIA can be alleviated, so that reflection at VIA can be suppressed and pass characteristics can be improved.

In the examples of FIGS. 13 and 14, the example in which the GND VIA 101 is arranged in the vicinity of the VIA 72 connecting the second layer and the third layer has been described. However, the GND VIA 101 may be arranged in the vicinity of the VIA 71 connecting the first layer and the second layer.

Fourth Structure Example of Distributor/Synthesizer

Next, the fourth structure of the distributor/synthesizer 24 will be described with reference to FIGS. 15 and 16.

Figure 15:
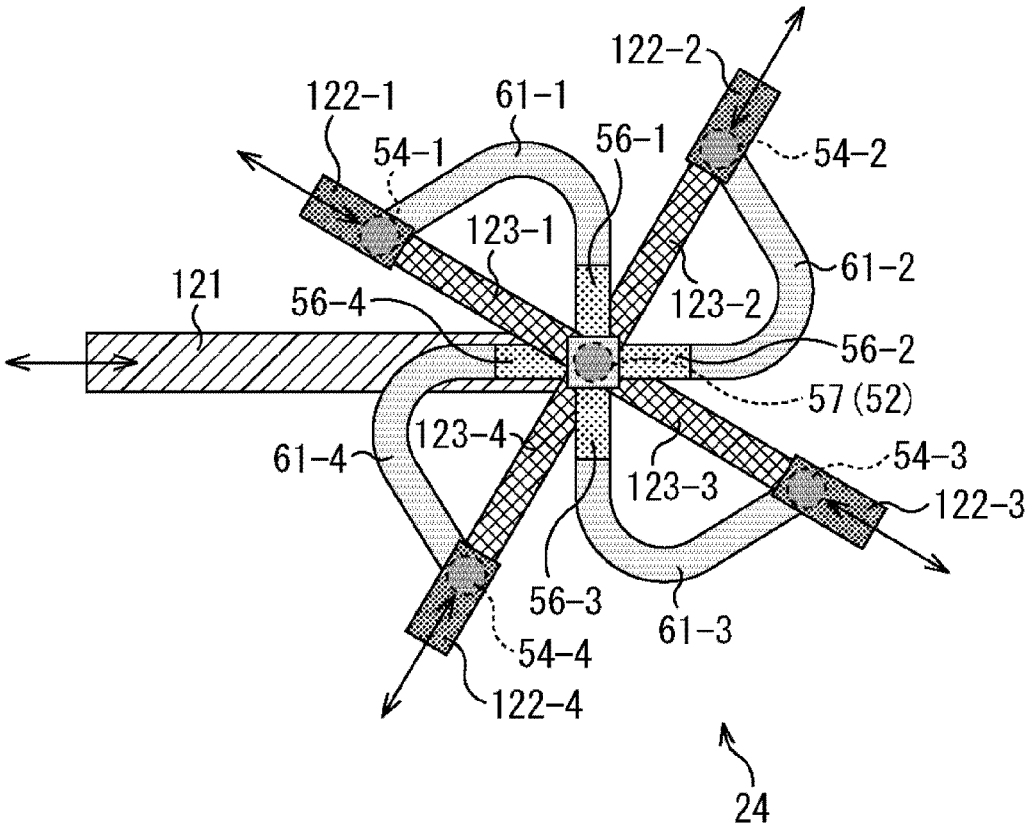
FIG. 15 is a plan view showing a fourth structure example of a distributor/synthesizer.

FIG. 15 is a plan view schematically showing a structure example of the distributor/synthesizer 24. FIG. 16 is a cross-sectional view schematically showing an example of the layer structure of the distributor/synthesizer 24.

Figure 16:
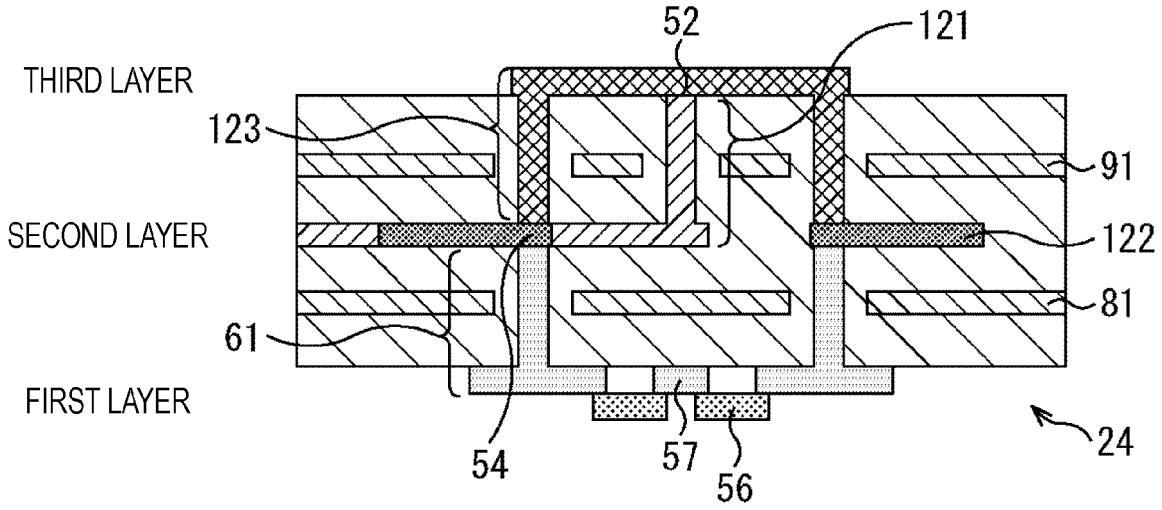
FIG. 16 is a cross-sectional view showing the fourth structure example of a distributor/synthesizer.

FIGS. 15 and 16 show examples in which the layer structure of the distributor/synthesizer 24 of FIGS. 5 and 6 is changed. In the example of FIGS. 15 and 16, since the structure is the same as the structures of FIGS. 5 and 6 except that the layer structure is changed, the description thereof is omitted.

The distributor/synthesizer 24 of FIGS. 15 and 16 is different from the distributor/synthesizer 24 of FIGS. 5 and 6 in that the input transmission lines 62-1 to 62-4 are replaced with the input transmission lines 121-1 to 121-4, the output transmission lines 63-1 to 63-4 are replaced with the output transmissions lines 122-1 to 122-4, and the distribution lines 53-1 to 53-4 are replaced with the distribution lines 123-1 to 123-4. The distributor/synthesizer 24 of FIGS. 15 and 16 is the same as the distributor/synthesizer 24 of FIGS. 5 and 6 in other points.

Hereinafter, the input transmission lines 121-1 to 121-4 are collectively referred to as the input transmission line 121, the output transmission lines 122-1 to 122-4 are collectively referred to as the output transmission line 122, and the distribution lines 123-1 to 123-4 are collectively referred to as the distribution line 123 in a case where it is not particularly necessary to distinguish them.

FIGS. 15 and 16 show an example in which the distributor/synthesizer 24 is configured as a quadrant distributor/synthesizer having a multilayer substrate structure including three wiring layers constituting the first to third layers and two layers of GND layer 81 and GND layer 91 in order from the bottom. The GND layer 81 is provided between the first layer and the second layer. The GND layer 91 is provided between the second layer and the third layer.

In FIG. 15, the input branch unit 52 and the coupling terminal 57 are arranged at the same position in different layers. The phase adjustment line 61 is configured to connect from the input branch unit 52 to the output branch unit 54 by a substantially parabolic path such that the length from the input branch unit 52 to the output branch unit 54 is $\lambda/2$ or an integral multiple thereof, where A is the wavelength of the signal.

In the cross-sectional structure of FIG. 16, parts of the paths of the coupling terminal 57, the isolation resistor 56, and the phase adjustment line 61 are arranged in the first layer which is the lowest layer. The phase adjustment line 61 includes a part of path and a path connecting the second layer and the third layer. The phase adjustment line 61 is connected to the output transmission line 122 of the second layer at the output branch unit 54 via a path connecting the second layer and the third layer.

In the second layer, a part of the path of the input transmission line 121 and the output transmission line 122 are formed by strip lines. The input transmission line 121 includes a part of the path and a path connecting the third layer and the second layer. The input transmission line 121 is connected to the distribution line 123 of the third layer at the input branch unit 52 through a path connecting the third layer and the second layer.

In the third layer, a part of the path of the distribution line 123 is formed by a microstrip line. The distribution line 123 includes a part of the path and a via connecting the third layer and the second layer. The distribution line 123 is connected to the output transmission line 122 of the second layer at the output branch unit 54 via the via.

Here, both the input transmission line 121 and the output transmission line 122 often take the value of 50Ω. On the other hand, the distribution line 123 requires higher characteristic impedance than the input transmission line 121 and the output transmission line 122 so that the distribution line takes the value of 100Ω in four distributions. If these transmission lines are mounted on the same plane, the design may have a line width that is difficult to achieve.

Therefore, in the distributor/synthesizer 24 of FIGS. 15 and 16, the input transmission line 121 and the output transmission line 122 are designed with strip lines that tend to have relatively low impedance. The distribution line 123 can be designed with a microstrip line having a higher impedance than the strip line when compared with the same line width. As described above, design can be made with a sufficiently achievable line width.

Although the case where the phase adjustment unit 55 is configured as the phase adjustment line 61 has been described above, the phase adjustment unit 55 may be configured as follows.

<Configuration Example of Phase Adjustment Unit>

Figure 17:
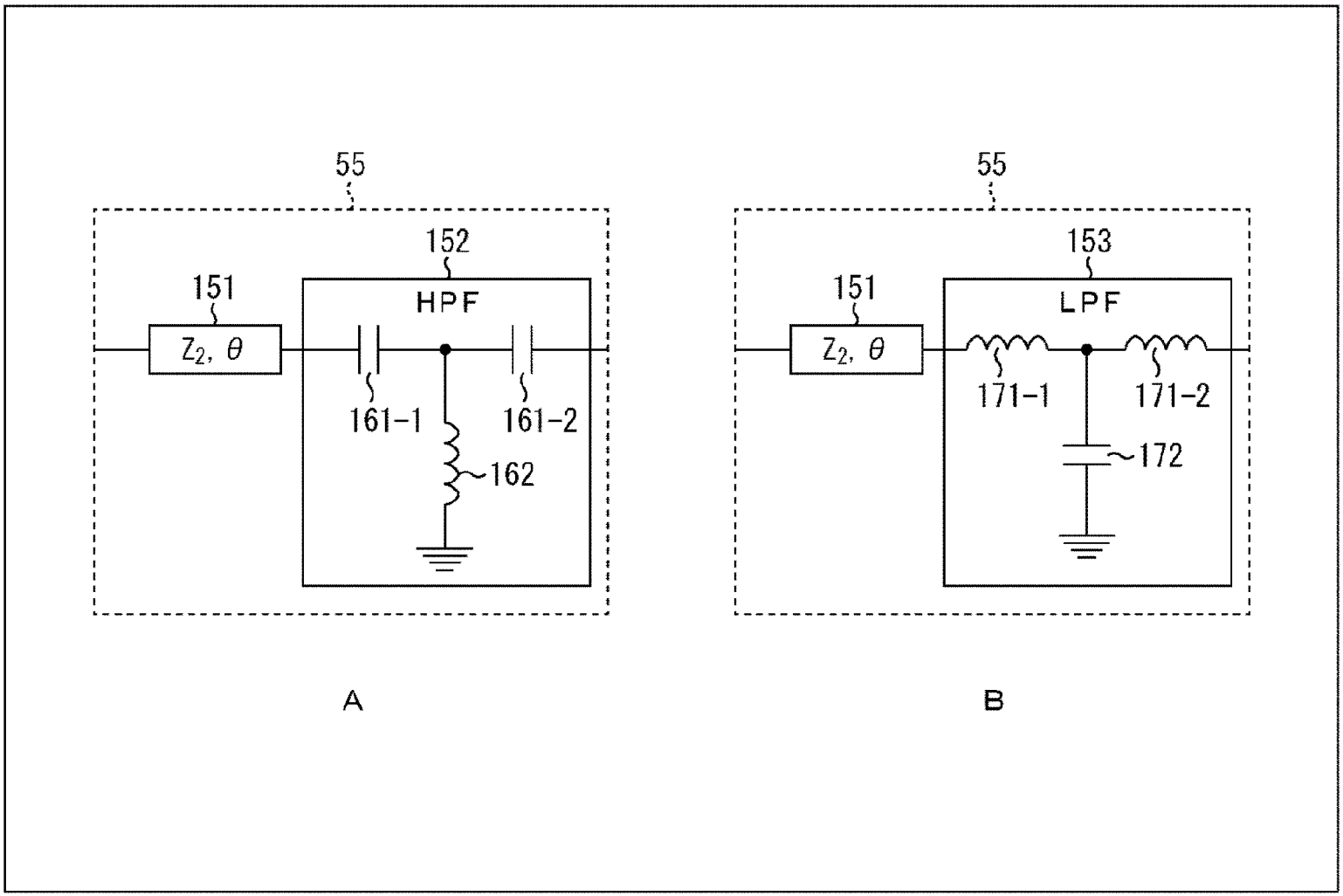
FIG. 17 is a block diagram showing a configuration example of a phase adjustment unit.

FIG. 17 is a block diagram showing a configuration example of the phase adjustment unit 55.

The phase adjustment unit 55 of FIG. 17 includes a transmission line 151 having an arbitrary phase rotation amount θ and a delay circuit including a lumped constant.

A of FIG. 17 shows an example in which the lumped constant is a high pass filter (HPF) 152 including capacitors 161-1 and 161-2 and a coil 162.

B of FIG. 17 shows an example in which the lumped constant is a low pass filter (LPF) 153 including coils 171-1 and 171-2 and a capacitor 172.

In the phase adjustment unit 55, the impedance characteristic $Z_2$ in the transmission line 151 may be anything, and matching can be performed by selecting a lumped constant value for an arbitrary 8.

Even in a case where the transmission line 151 of the phase adjustment unit 55 cannot be adjusted to a length having a phase rotation amount that of π[rad] or a real number multiple of π[rad], the phase can be adjusted to π[rad] or a real number multiple of π[rad] by adding a delay circuit using an LC lumped constant.

Note that the phase adjustment unit 55 is not limited to the one described above, and may be anything as long as it adjusts the phase, and may be a phase shifter.

As described above, in the present technology, the phase adjustment unit that is connected in series with the resistor is provided, so that even in a case where the size of the VIA or the resistor is not sufficiently small with respect to the wavelength, a design that does not impair the isolation characteristics is possible.

Furthermore, according to the present technology, since the phase adjustment unit has a size, the degree of freedom in mounting the isolation resistor is increased, so that mounting can be made on the substrate with a reasonable structure.

Furthermore, a distributor/synthesizer having three or more distributions can achieve more downsizing and lower loss than a multi-distributor/synthesizer in which the conventional Wilkinson two-distributor shown in FIG. 10 is tournament-connected.

The present technology is also applied to a distributor/synthesizer, a distributor, and a synthesizer, and a mobile phone, a smartphone, a tablet terminal, a personal computer, a mobile terminal, and the like including these.

While preferred embodiments of the present disclosure have been described in detail with reference to the accompanying drawings, the disclosure is not limited to such examples. It is obvious that various variations and modifications can be conceived within the scope of the technical idea described in the claims by a person having ordinary knowledge in the field of technology to which the present disclosure belongs, and, of course, it is understood that these variations and modifications belong to the technical scope of present disclosure.

Note that, the present technology can adopt the following configuration.

(1)

A distributor formed on a substrate and including:

an input branch unit connected to an external transmission line on an input side;

a distribution line that distributes a path from the input branch unit into n;

an output branch unit that is connected to an output side of the distribution line and divides re-distributed paths into an internal side and the external transmission line on the output side;

a coupling terminal that couples the n-distributed paths on the internal side; and a phase adjustment unit that is arranged between the output branch unit and the coupling terminal so as to be connected in series with a resistor, and adjusts a phase, in which a phase rotation amount from the input branch unit to the output branch unit of each of the re-distributed paths is $\pi/2$ [rad], and a phase rotation amount from the output branch unit to the coupling terminal is $\pi$[rad] or a real number multiple of $\pi$[rad] including magnitude of the resistor.

(2)

The distributor according to (1) described above, in which the phase adjustment unit is arranged between the output branch unit and the resistor.

(3)

The distributor according to (1) described above, in which the phase adjustment unit is arranged between the resistor and the coupling terminal.

(4)

The distributor according to (1) described above, in which the phase adjustment unit includes a first phase adjustment unit connected to the output branch unit, and a second phase adjustment unit connected to the coupling terminal, and the resistor is arranged between the first phase adjustment unit and the second phase adjustment unit.

(5)

The distributor according to any of (1) to (4) described above, in which, when input impedance is $Z_{in}$, output impedance is $Z_{out}$, and distribution number is n, characteristic impedance $Z_1$ of the distribution line is designed as $\sqrt{(n\ Z_{in}\ Z_{out})}$, and a resistance value R of the resistor is designed as $Z_{out}$.

(6)

The distributor according to (5) described above, in which characteristic impedance $Z_2$ of the phase adjustment unit is designed to be in a range of $Z_{out}/2 \leq Z_2 \leq 2*Z_{out}$.

(7)

The distributor according to any of (1) to (6) described above, in which the phase adjustment unit is achieved by a phase adjustment line whose length from the input branch unit to the output branch unit is $\lambda/2$ or an integral multiple of $\lambda/2$.

(8)

The distributor according to any of (1) to (7) described above, in which at least one of the distribution line or the phase adjustment unit includes one or more structures that connect different planes, and the input branch unit and the coupling terminal are located on different planes.

(9)

The distributor according to (8) described above, in which the input branch unit and the coupling terminal are on the same vertical line, and the distribution line, the phase adjustment unit, and the isolation resistor are arranged n times symmetrically about the vertical line.

(10)

A synthesizer formed on a substrate and including:

an input branch unit that is connected to an external transmission line on an input side, and divides each of n paths into an internal side and a synthesis line;

an output synthesis unit that synthesizes synthesis lines divided for each of the n paths, and is connected to an external transmission line on an output side;

a coupling terminal that couples the n paths on the internal side; and a phase adjustment unit that is arranged between the input branch unit and the coupling terminal so as to be connected in series with a resistor, and adjusts a phase, in which a phase rotation amount from the input branch unit to the output synthesis unit of each of the n paths is $\pi/2$ [rad], and a phase rotation amount from the input branch unit to the coupling terminal is $\pi$[rad] or a real number multiple of $\pi$[rad].

(11)

The synthesizer according to (10) described above, in which the phase adjustment unit is arranged between the input branch unit and the resistor.

(12)

The synthesizer according to (10) described above, in which the phase adjustment unit is arranged between the resistor and the coupling terminal.

(13)

The synthesizer according to (10) described above, in which the phase adjustment unit includes a first phase adjustment unit connected to the input branch unit, and a second phase adjustment unit connected to the coupling terminal, and the resistor is arranged between the first phase adjustment unit and the second phase adjustment unit.

(14)

The synthesizer according to any of (10) to (13) described above, in which, when input impedance is $Z_{in}$, output impedance is $Z_{out}$, and distribution number is n, characteristic impedance $Z_1$ of the synthesis line is designed as $\sqrt{(n\ Z_{in}\ Z_{out})}$, and a resistance value R of the resistor is designed as $Z_{out}$.

(15)

The synthesizer according to (14) described above, in which characteristic impedance $Z_2$ of the phase adjustment unit is designed to be in a range of $Z_{out}/2 \leq Z_2 \leq 2*Z_{out}$.

(16)

The synthesizer according to any of (10) to (15) described above, in which the phase adjustment unit is achieved by a phase adjustment line whose length from the input branch unit to the output synthesis unit is $\lambda/2$ or an integral multiple of $\lambda/2$.

(17)

The synthesizer according to any of (10) to (16) described above, in which at least one of the synthesis line or the phase adjustment unit includes one or more structures that connect different planes, and the output synthesis unit and the coupling terminal are located on different planes.

(18)

The synthesizer according to (17) described above, in which the output synthesis unit and the coupling terminal are on the same vertical line, and the synthesis line, the phase adjustment unit, and the resistor are arranged n times symmetrically about the vertical line.

REFERENCE SIGNS LIST

11 Transmission and reception unit
21-1, 21-2 Amplifier
22-1, 22-2 Filter
23 Switch
24 Distributor/synthesizer
25-1 to 25-4 Phase shifter
26-1 to 26-4 Antenna
51 Input and output terminal
52 Input branch unit
53, 53-1 to 53-8 Distribution line
54 Output branch unit
55, 55-1 to 55-8 Phase adjustment unit
56, 56-1 to 56-8 Isolation resistance
57 Coupling terminal
58, 58-1 to 58-8 Input and output terminal
61, 61-1 to 61-8 Phase adjustment line
62 Input transmission line
63, 63-1 to 63-8 Output transmission line
71, 72 VIA
81 GND layer
91 GND layer
101, 101-1 to 101-4 GND VIA
121 Input transmission line
122 Output transmission line
123, 123-1 to 123-4 Distribution line
151 Transmission line
152 HPF
153 LPF
161-1 and 161-2 Capacitor
162 Coil
171-1 and 171-2 Coil
172 Capacitor

The invention claimed is:

1. A distributor formed on a substrate, the distributor comprising:

an input branch connected to an external transmission line on an input side;

a distribution line that distributes a path from the input branch unit into n;

an output branch that is connected to an output side of the distribution line and divides n-distributed paths into an internal side and the external transmission line on the output side;

a coupling terminal that couples the n-distributed paths on the internal side; and a phase adjustment line that is arranged between the output branch and the coupling terminal so as to be connected in series with a resistor, and adjusts a phase, wherein a phase rotation amount from the input branch to the output branch of each of the n-distributed paths is $\pi/2$ [rad], a phase rotation amount from the output branch to the coupling terminal is $\pi$ [rad] or a real number multiple of $\pi$ [rad] including magnitude of the resistor, at least one of the distribution line or the phase adjustment line includes one or more structures that connect different planes, and the input branch and the coupling terminal are located on different planes.

2. The distributor according to claim 1, wherein the phase adjustment line is arranged between the output branch and the resistor.

3. The distributor according to claim 1, wherein the phase adjustment line is arranged between the resistor and the coupling terminal.

4. The distributor according to claim 1, wherein the phase adjustment line has a length from the input branch to the output branch of $\lambda/2$ or an integral multiple of $\lambda/2$.

5. The distributor according to claim 1, wherein the input branch and the coupling terminal are on a same vertical line, and the distribution line, the phase adjustment line, and the resistor are arranged n times symmetrically about the vertical line.

6. A distributor formed on a substrate, the distributor comprising:

an input branch connected to an external transmission line on an input side;

a distribution line that distributes a path from the input branch into n;

an output branch that is connected to an output side of the distribution line and divides n-distributed paths into an internal side and the external transmission line on the output side;

a coupling terminal that couples the n-distributed paths on the internal side; and a phase adjustment line that is arranged between the output branch and the coupling terminal so as to be connected in series with a resistor, and adjusts a phase, wherein a phase rotation amount from the input branch to the output branch of each of the n-distributed paths is $\pi/2$ [rad], a phase rotation amount from the output branch to the coupling terminal is $\pi$ [rad] or a real number multiple of $\pi$ [rad] including magnitude of the resistor, the phase adjustment line includes a first phase adjustment portion connected to the output branch, and a second phase adjustment portion connected to the coupling terminal, and the resistor is arranged between the first phase adjustment portion and the second phase adjustment portion.

7. A distributor formed on a substrate, the distributor comprising:

an input branch connected to an external transmission line on an input side;

a distribution line that distributes a path from the input branch into n;

an output branch that is connected to an output side of the distribution line and divides n-distributed paths into an internal side and the external transmission line on the output side;

a coupling terminal that couples the n-distributed paths on the internal side; and a phase adjustment line that is arranged between the output branch and the coupling terminal so as to be connected in series with a resistor, and adjusts a phase, wherein a phase rotation amount from the input branch to the output branch of each of the n-distributed paths is $\pi/2$ [rad], a phase rotation amount from the output branch to the coupling terminal is $\pi$ [rad] or a real number multiple of $\pi$ [rad] including magnitude of the resistor, and wherein, when input impedance is $Z_{in}$, output impedance is $Z_{out}$, and distribution number is n, characteristic impedance $Z_1$ of the distribution line is designed as $\sqrt{(n\ Z_{in}\ Z_{out})}$, and a resistance value R of the resistor is designed as $Z_{out}$.

8. The distributor according to claim 7, wherein characteristic impedance $Z_2$ of the phase adjustment line is configured to be in a range of $Z_{out}/2 \leq Z_2 \leq 2*Z_{out}$.

9. A synthesizer formed on a substrate, the synthesizer comprising:

an input branch that is connected to an external transmission line on an input side, and divides each of n paths into an internal side and a synthesis line;

an output synthesis unit that synthesizes synthesis lines divided for each of the n paths, and is connected to an external transmission line on an output side;

a coupling terminal that couples the n paths on the internal side; and a phase adjustment line that is arranged between the input branch and the coupling terminal so as to be connected in series with a resistor, and adjusts a phase, wherein a phase rotation amount from the input branch to the output synthesis unit of each of the n paths is $\pi/2$ [rad], a phase rotation amount from the input branch to the coupling terminal is $\pi$ [rad] or a real number multiple of $\pi$ [rad], at least one of the synthesis line or the phase adjustment line includes one or more structures that connect different planes, and the output synthesis unit and the coupling terminal are located on different planes.

10. The synthesizer according to claim 9, wherein the phase adjustment line is arranged between the input branch and the resistor.

11. The synthesizer according to claim 9, wherein the phase adjustment line is arranged between the resistor and the coupling terminal.

12. The synthesizer according to claim 9, wherein the phase adjustment has a length from the input branch to the output synthesis unit of $\lambda/2$ or an integral multiple of $\lambda/2$.

13. The synthesizer according to claim 9, wherein the output synthesis unit and the coupling terminal are on a same vertical line, and the synthesis line, the phase adjustment line, and the resistor are arranged n times symmetrically about the vertical line.

14. A synthesizer formed on a substrate, the synthesizer comprising:

an input branch that is connected to an external transmission line on an input side, and divides each of n paths into an internal side and a synthesis line;

an output synthesis unit that synthesizes synthesis lines divided for each of the n paths, and is connected to an external transmission line on an output side;

a coupling terminal that couples the n paths on the internal side; and a phase adjustment line that is arranged between the input branch and the coupling terminal so as to be connected in series with a resistor, and adjusts a phase, wherein a phase rotation amount from the input branch to the output synthesis unit of each of the n paths is $\pi/2$ [rad], a phase rotation amount from the input branch to the coupling terminal is $\pi$ [rad] or a real number multiple of $\pi$ [rad], wherein the phase adjustment line includes a first phase adjustment portion connected to the input branch, and a second phase adjustment portion connected to the coupling terminal, and the resistor is arranged between the first phase adjustment portion and the second phase adjustment portion.

15. A synthesizer formed on a substrate, the synthesizer comprising:

an input branch that is connected to an external transmission line on an input side, and divides each of n paths into an internal side and a synthesis line;

an output synthesis unit that synthesizes synthesis lines divided for each of the n paths, and is connected to an external transmission line on an output side;

a coupling terminal that couples the n paths on the internal side; and a phase adjustment line that is arranged between the input branch and the coupling terminal so as to be connected in series with a resistor, and adjusts a phase, wherein a phase rotation amount from the input branch to the output synthesis unit of each of the n paths is $\pi/2$ [rad], and a phase rotation amount from the input branch to the coupling terminal is $\pi$ [rad] or a real number multiple of $\pi$ [rad], and wherein, when input impedance is $Z_{in}$, output impedance is $Z_{out}$, and distribution number is n, characteristic impedance $Z_1$ of the synthesis line is designed as $\sqrt{(n\ Z_{in}\ Z_{out})}$, and a resistance value R of the resistor is designed as $Z_{out}$.

16. The synthesizer according to claim 15, wherein characteristic impedance $Z_2$ of the phase adjustment line is configured to be in a range of $Z_{out}/2 \leq Z_2 \leq 2*Z_{out}$.

* * * * *